US011891752B2

(12) United States Patent
Romain

(10) Patent No.: US 11,891,752 B2
(45) Date of Patent: Feb. 6, 2024

(54) MICROWAVABLE MATERIAL SMOOTHING APPARATUS

(71) Applicant: Pierre Romain, Houston, TX (US)

(72) Inventor: Pierre Romain, Houston, TX (US)

( * ) Notice: Subject to any disclaimer, the term of this patent is extended or adjusted under 35 U.S.C. 154(b) by 0 days.

(21) Appl. No.: 17/569,484

(22) Filed: Jan. 5, 2022

(65) Prior Publication Data

US 2022/0213643 A1 Jul. 7, 2022

Related U.S. Application Data

(60) Provisional application No. 63/133,869, filed on Jan. 5, 2021.

(51) Int. Cl.

| | |
|---|---|
| ***D06F 75/06*** | (2006.01) |
| ***D06F 75/34*** | (2006.01) |
| ***D06F 75/38*** | (2006.01) |

(52) U.S. Cl.

CPC ..... *D06F 75/06* (2013.01); *D06F 75/34* (2013.01); *D06F 75/38* (2013.01)

(58) Field of Classification Search

CPC ..... D06F 75/02; D06F 75/04; D06F 75/243; D06F 75/06; D06F 75/34; D06F 75/38

See application file for complete search history.

(56) References Cited

U.S. PATENT DOCUMENTS 686,080 A 11/1901 Joyce
1,376,242 A * 4/1921 Ast ..... D06F 75/38 38/93
2,215,960 A 9/1940 Gough
2,540,579 A * 2/1951 Hanner ..... D06F 75/34 38/90
2,592,489 A 4/1952 Thomas et al.
2,763,075 A 9/1956 Vance
3,229,392 A * 1/1966 Camilleri ..... D06F 75/34 38/90
3,672,080 A 6/1972 Murphy et al.

(Continued)

FOREIGN PATENT DOCUMENTS

CN 202202172 U * 4/2012 ..... D06F 75/10
CN 104233746 A 12/2014

(Continued)

OTHER PUBLICATIONS

Related PCT Application No. PCT/US22/11352 filed Jan. 5, 2022, entitled "Microwavable Material Smoothing Apparatus", Inventor: Pierre Romain.

(Continued)

*Primary Examiner* — Ismael Izaguirre

(74) *Attorney, Agent, or Firm* — BEKIARES ELIEZER LLP

(57) ABSTRACT

Aspects of the present disclosure provide a fabric smoothing apparatus comprising: a microwavable base module comprising: a first substantially planar surface, and a divot spanning the perimeter of the first substantially planar surface; and a hand grip module comprising: a hand grip disposed on a top portion of a second substantially planar surface, and a lip disposed on a bottom portion of the second substantially planar surface, wherein the hand grip module is dimensioned to releasably secure the microwavable base module via the lip securing into the divot.

20 Claims, 29 Drawing Sheets

(56) References Cited

U.S. PATENT DOCUMENTS

| | | | | |
|---|---|---|---|---|
| 4,716,276 | A | 12/1987 | Motegi et al. | |
| 4,849,593 | A | 7/1989 | Hughes et al. | |
| 6,138,389 | A | 10/2000 | Kanazawa et al. | |
| 7,681,342 | B2 | 3/2010 | Choi | |
| 8,166,681 | B2 | 5/2012 | Janakiraman et al. | |
| 9,328,454 | B2 | 5/2016 | Adkins et al. | |
| 2001/0030183 | A1* | 10/2001 | Bowen | D06F 75/30 101/31 |
| 2005/0172442 | A1 | 8/2005 | Trunecek | |

FOREIGN PATENT DOCUMENTS

| | | | | | |
|---|---|---|---|---|---|
| CN | 104805669 | A | | 7/2015 | |
| CN | 106835658 | A | | 6/2017 | |
| CN | 108823930 | A | | 11/2018 | |
| CN | 108842414 | A | | 11/2018 | |
| CN | 107653655 | B | | 1/2019 | |
| CN | 110284312 | A | | 9/2019 | |
| DE | 29804081 | U1 | | 6/1998 | |
| DE | 19904587 | A1 | | 8/2000 | |
| EP | 0711862 | A1 | | 5/1996 | |
| EP | 3217763 | A2 | | 9/2017 | |
| ES | 2394396 | | | 1/2013 | |
| FR | 3097238 | A1 | | 12/2020 | |
| GB | 512071 | | | 8/1939 | |
| GB | 2470485 | A | * | 11/2010 | D06F 75/10 |
| IT | 1225775 | B | * | 11/1990 | |
| JP | 2007202818 | A | | 8/2007 | |
| JP | 2011129252 | A | | 6/2011 | |
| KR | 200208038 | | | 12/2000 | |
| KR | 20020005252 | A | | 1/2002 | |
| KR | 1020060114224 | | | 11/2006 | |
| KR | 101328406 | B1 | | 11/2013 | |
| KR | 20180137145 | A | | 12/2018 | |
| KR | 102070751 | B1 | | 1/2020 | |
| WO | 03062518 | A1 | | 7/2004 | |
| WO | 2011080026 | A2 | | 7/2011 | |
| WO | 2013176125 | A1 | | 11/2013 | |
| WO | 2014079982 | A1 | | 5/2014 | |

OTHER PUBLICATIONS

International Search Report and Written Opinion dated Mar. 25, 2022, 13 pgs.

Collection of Vintage Cast Iron Irons Stock Image—Image of cast, historical: 170091521, https://www.dreamstime.com/collection-vintage-cast-iron-irons-collection-vintage-cast-iron-irons-old-smoke-irons-vintage-charcoal-irons-retro-ironing-, Aug. 18, 2020, 3 pgs.

* cited by examiner

MICROWAVABLE MATERIAL SMOOTHING APPARATUS

FIELD OF DISCLOSURE

The present disclosure generally relates to Material Smoothing and De-wrinkling.

BACKGROUND

Those who travel for business may need their formalwear pressed and ironed. When traveling, a typical hotel may provide an iron and ironing board, but less conventional stays such as renting a private residence via Airbnb or VRBO may not have an iron provided. Thus, the only apparent option is to use a dry cleaner. This often causes problems because the formalwear may be needed the day of arrival and the typical turnaround for a dry cleaner is at least 24 hours. A need for an easy to use, portable, and wireless ironing device is needed.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

In one aspect, embodiments of the present disclosure may provide a fabric smoothing apparatus including a hand grip module having a lower housing, and an upper housing. The upper housing may include at least one hand grip. The fabric smoothing apparatus may further include a microwavable base module having a top portion releasably secured to the lower housing, and a bottom portion configured to perform smoothing of a fabric.

In another aspect, embodiments of the present disclosure may provide a fabric smoothing apparatus including a microwavable base module having a first substantially planar surface, and a divot spanning the perimeter of the first substantially planar surface. The fabric smoothing apparatus may further include a hand grip module having a hand grip disposed on a top portion of a second substantially planar surface, and a lip disposed on a bottom portion of the second substantially planar surface. The hand grip module may be dimensioned to releasably secure the microwavable base module via the lip securing into the divot.

In another aspect, embodiments of the present disclosure may provide a fabric smoothing apparatus including a microwavable base module having a first substantially planar surface, and a divot spanning the perimeter of the first substantially planar surface and a hand grip module having a hand grip disposed on a top portion of a second substantially planar surface, and a lip disposed on a bottom portion of the second substantially planar surface. The hand grip module is dimensioned to releasably secure the microwavable base module via the lip securing into the divot.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
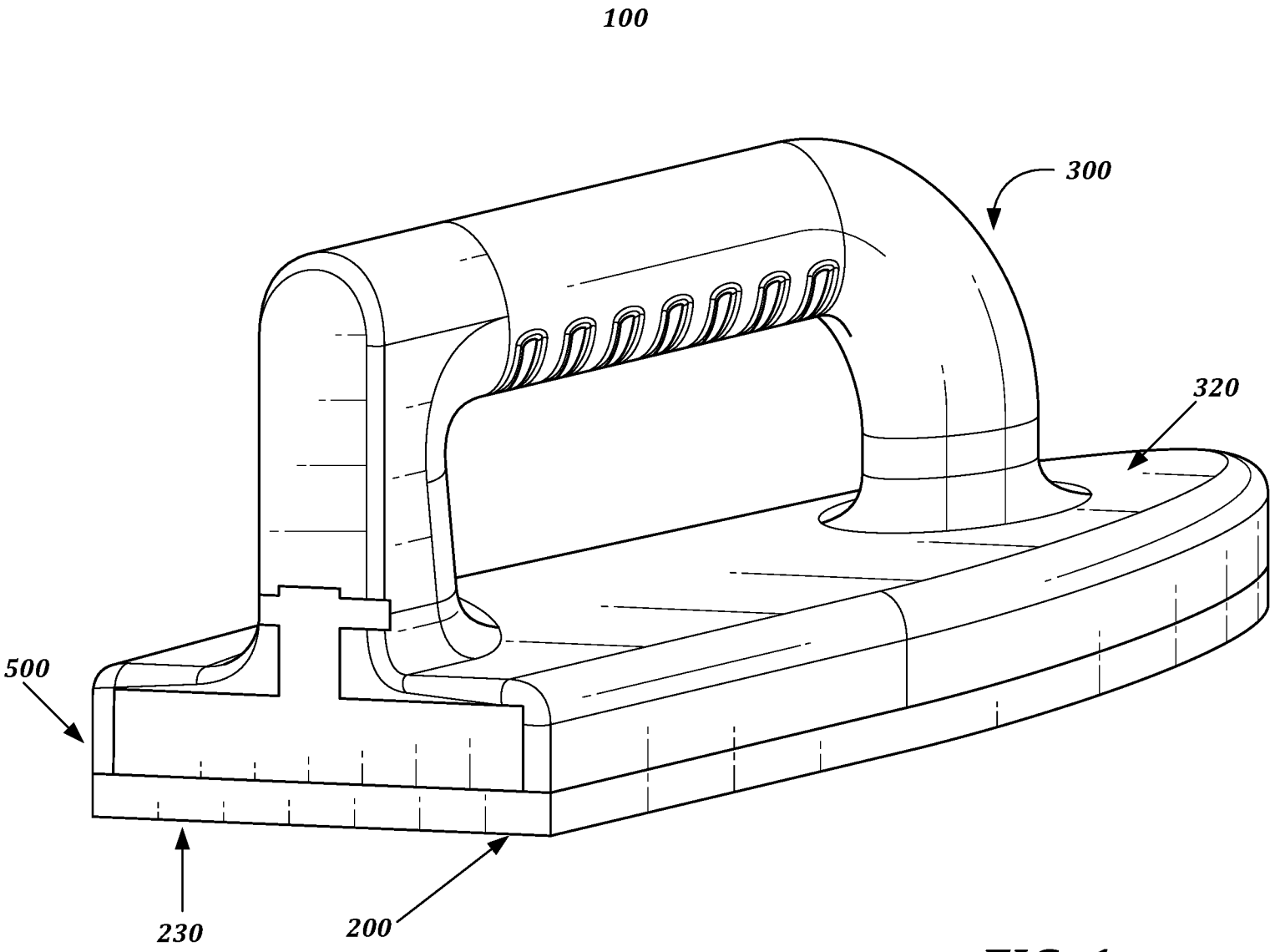
FIG. 1 is a perspective view of a Microwavable Material Smoothing Apparatus 100.
Figure 2:
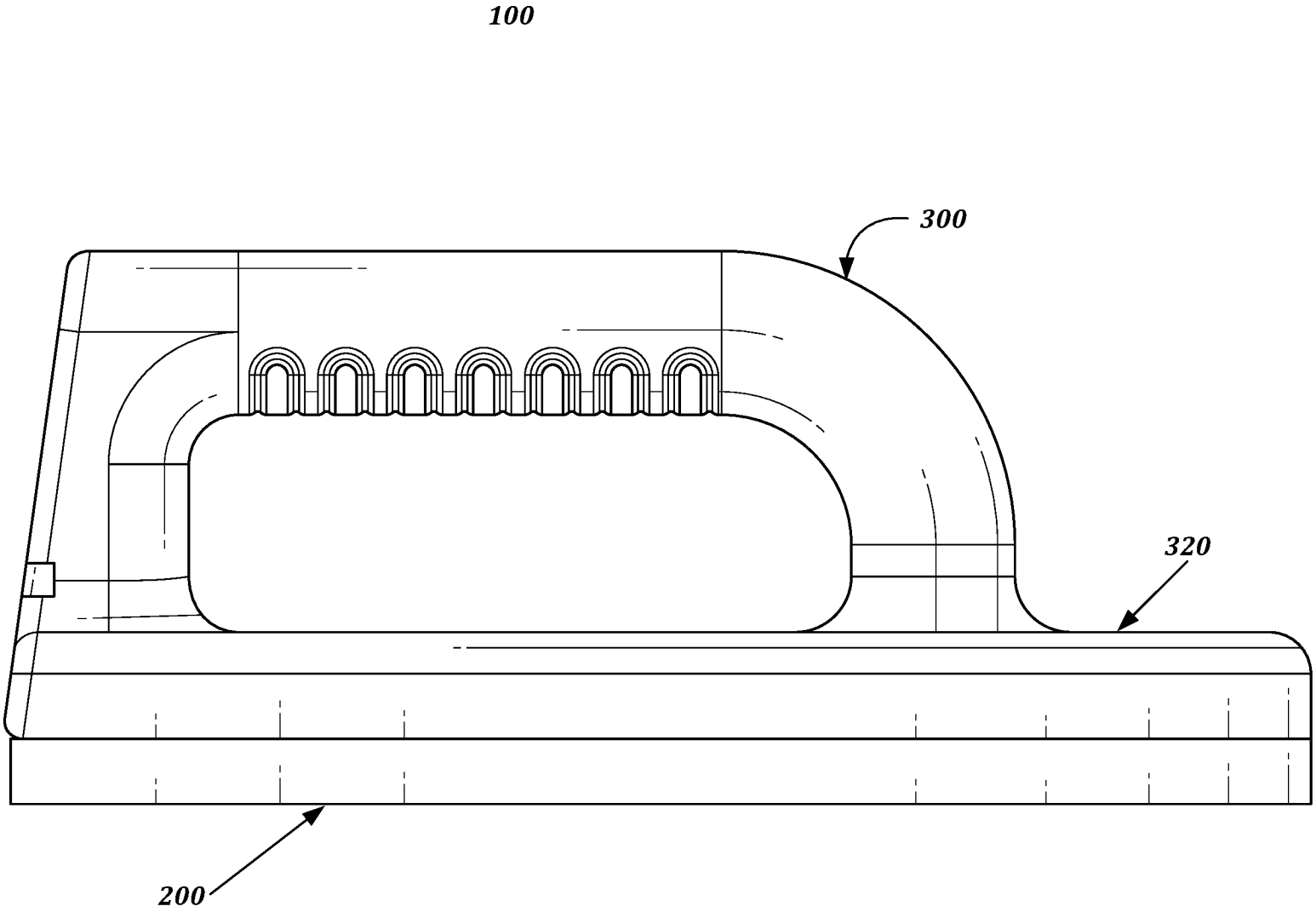
FIG. 2 is a side view thereof.
Figure 3:
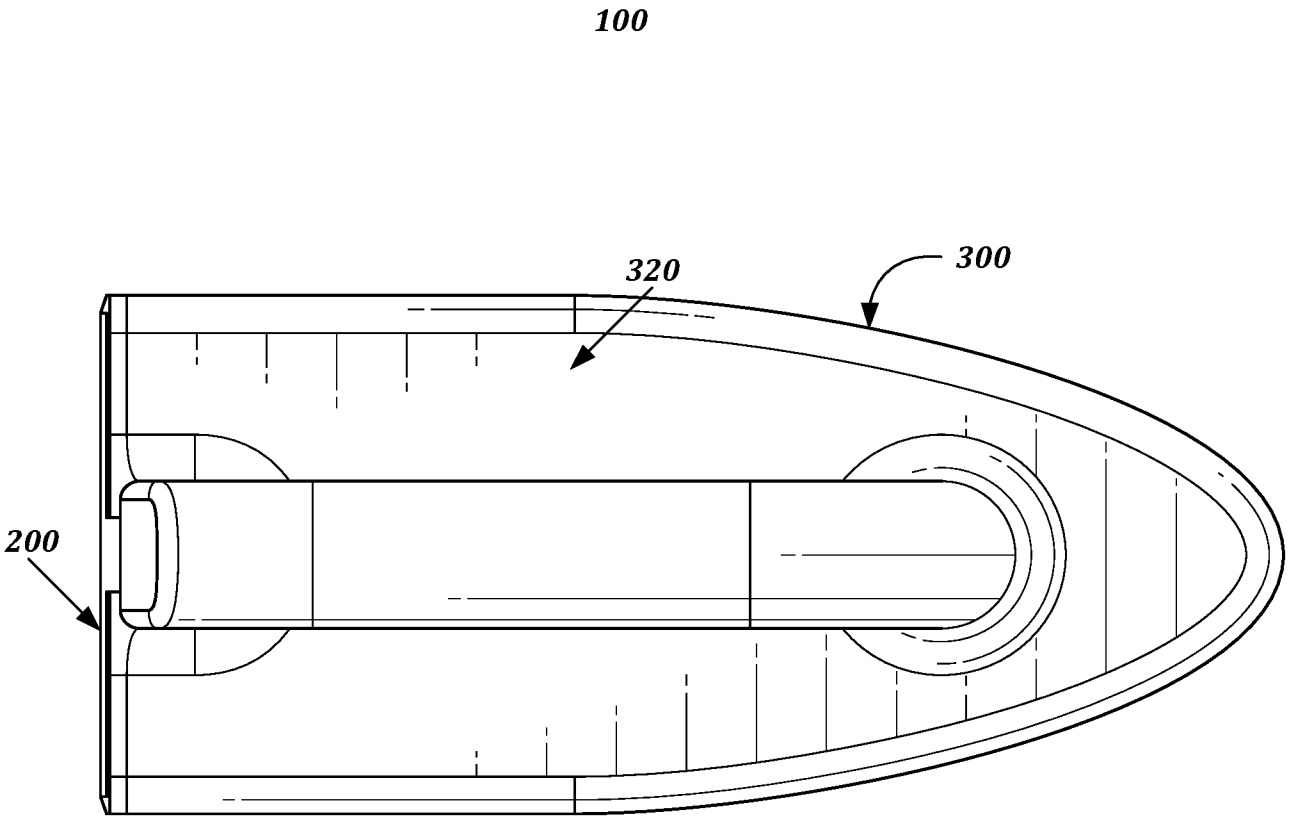
FIG. 3 is a top view thereof.
Figure 4:
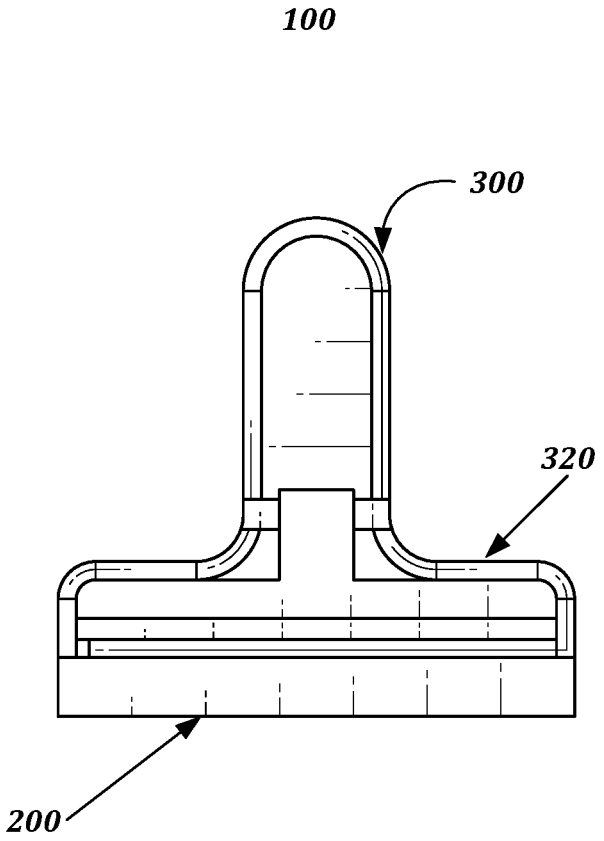
FIG. 4 is a back view thereof.
Figure 5:
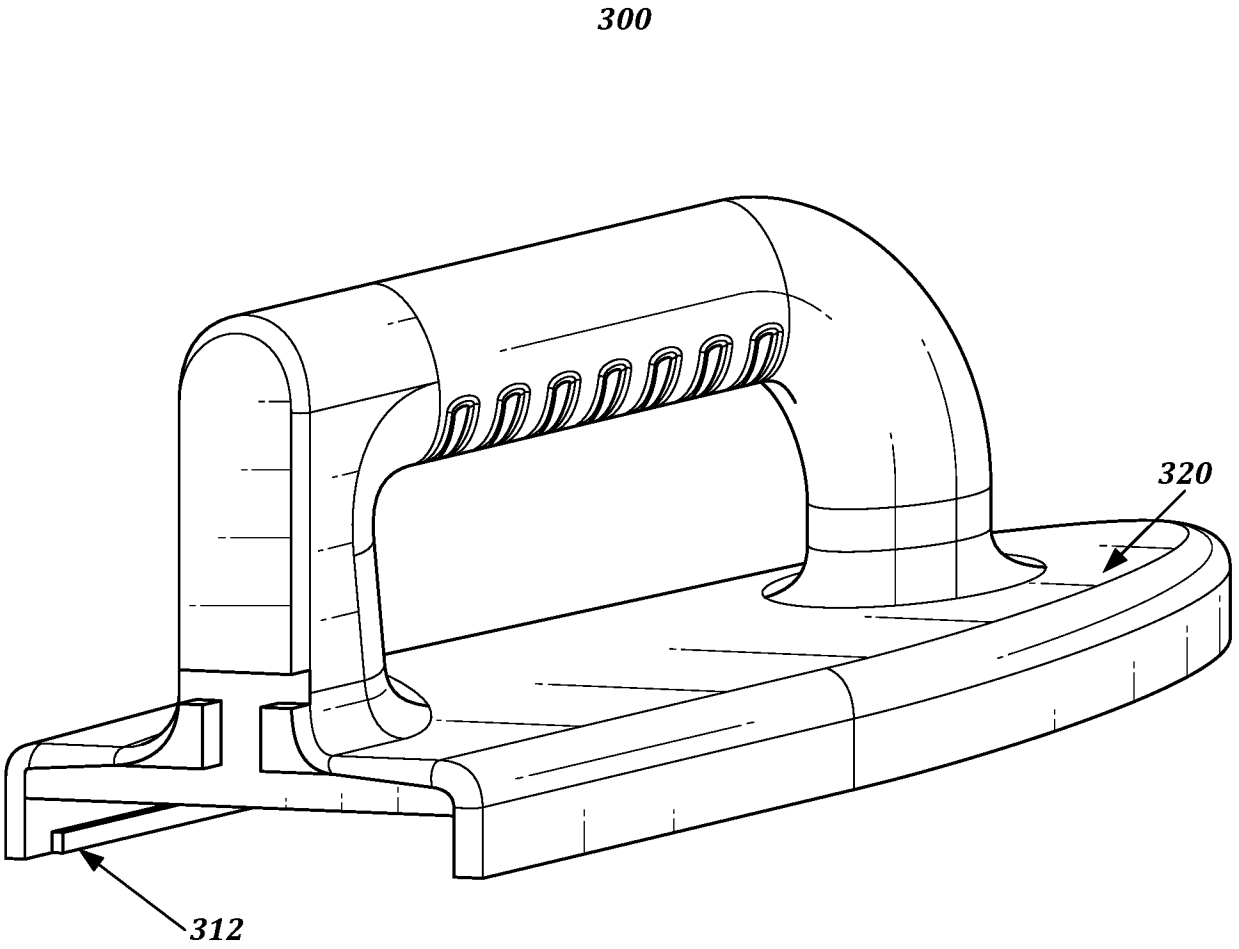
FIG. 5 is a perspective view of a hand grip module 300.
Figure 6:
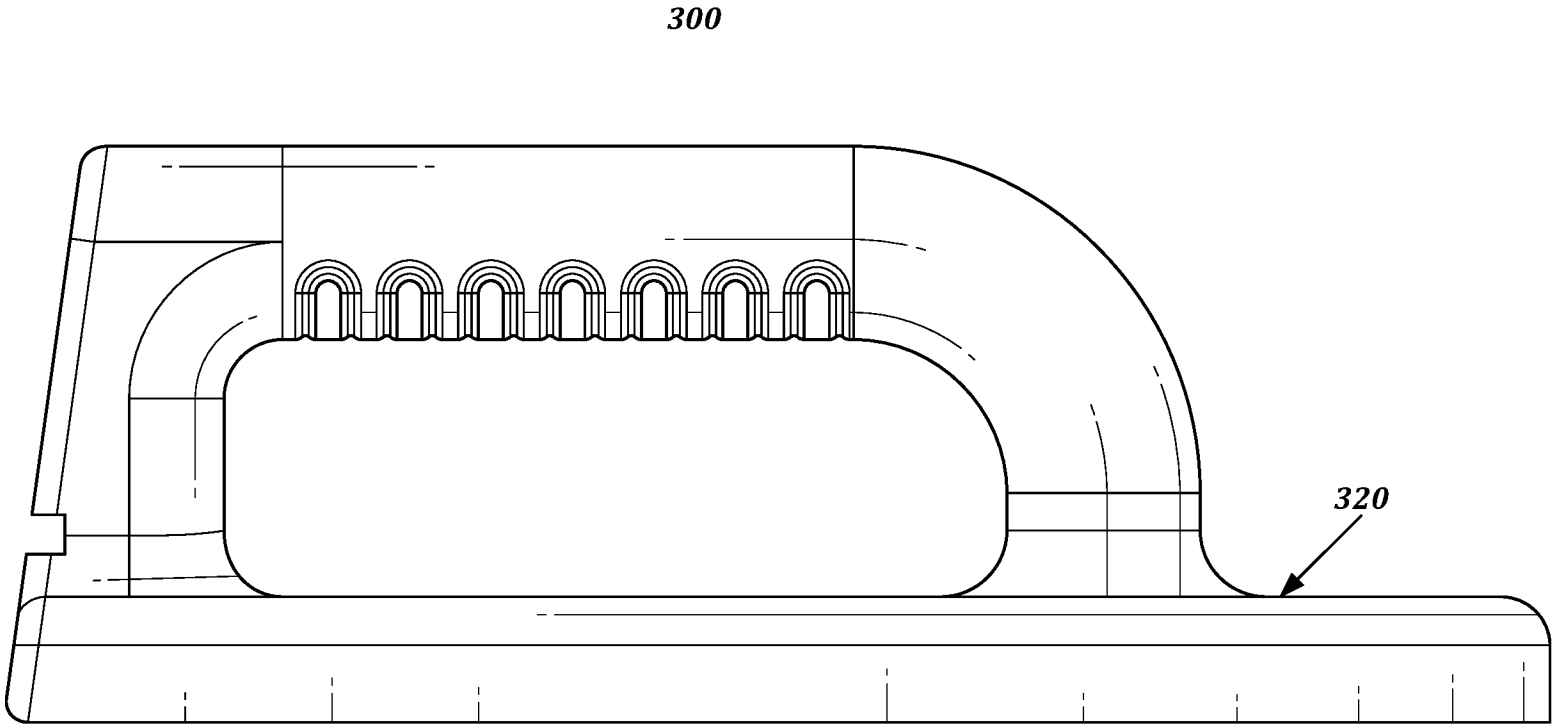
FIG. 6 is a side view thereof.
Figure 7:
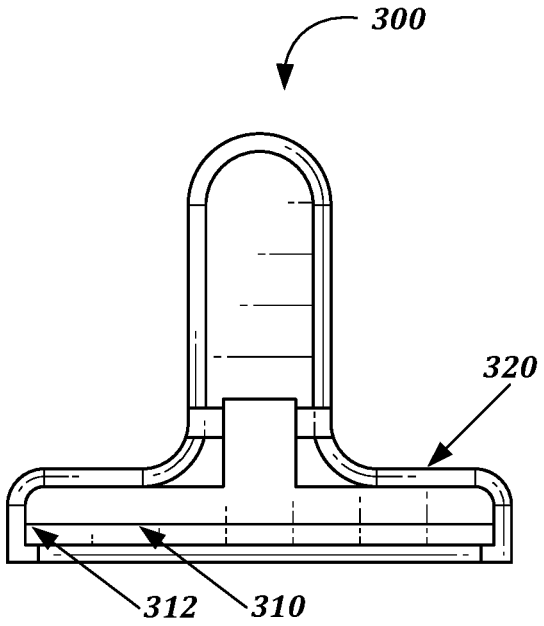
FIG. 7 is a back view thereof.
Figure 8:
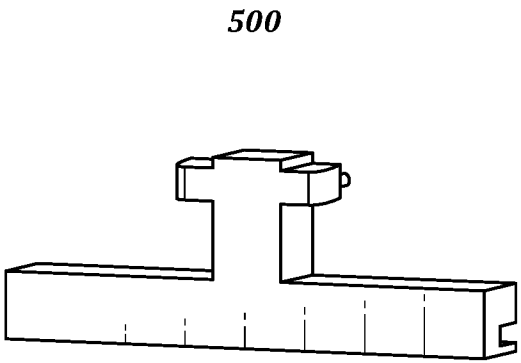
FIG. 8 is a perspective view of a base module securing portion 500.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term-differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of material smoothing and de-wrinkling, embodiments of the present disclosure are not limited to use only in this context.

I. APPARATUS OVERVIEW

This overview is provided to introduce a selection of concepts in a simplified form that are further described below. This overview is not intended to identify key features or essential features of the claimed subject matter. Nor is this overview intended to be used to limit the claimed subject matter's scope.

The present microwavable material smoothing apparatus 100 provides a smaller, portable, on-the-go version of a standard iron. The apparatus 100 may comprise a small base, attached to a handle. After a predetermined time in a microwave, the base becomes hot enough to smooth (e.g., iron out) folds and wrinkles in any fabric. The apparatus 100 may provide an easier alternative to bulky steamers, or even to standard irons for smaller ironing jobs.

Embodiments of the present disclosure may comprise methods, systems, and components comprising, but not limited to, at least one of the following:

A. A Base Module 200;

B. A Hand Grip Module 300;

In some embodiments, the present disclosure may provide an additional set of components for further facilitating the system. The additional set of components may comprise, but not be limited to:

C. A Liquid Dispensing Module 400; and

D. A Base Module Securing Portion 500.

Details with regards to each component are provided below. Although components are disclosed with specific functionality, it should be understood that functionality may be shared between components, with some functions split between components, while other functions duplicated by the components. Furthermore, the name of the component should not be construed as limiting upon the functionality of the component. Moreover, each stage disclosed within each component can be considered independently without the context of the other stages within the same component or different components. Each stage may contain language defined in other portions of this specifications. Each stage disclosed for one component may be mixed with the operational stages of another component. In the present disclosure, each stage can be claimed on its own and/or interchangeably with other stages of other components.

The following depicts an example of a method of a plurality of methods that may be performed by at least one of the aforementioned components. Various hardware components may be used at the various stages of operations disclosed with reference to each component. For example, although methods may be described to be performed by a single apparatus, it should be understood that, in some embodiments, different operations may be performed by different apparatuses in operating in conjunction with each other. For example, the base module, and the hand grip module may be employed in the performance of some or all of the stages disclosed with regard to the methods. Similarly, one apparatus may be employed in the performance of some or all of the stages of the methods. As such, the apparatus may comprise at least one of the architectural components disclosed herein.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

Consistent with embodiments of the present disclosure, a method may be performed by at least one of the aforementioned components. The method may comprise the following stages:

providing a base module 200 comprising a top portion 210 and a bottom portion 230;

wherein the top portion 210 comprises a hand grip base 212;

wherein the top portion 210 is comprised of rigid microwavable material; wherein the bottom portion 230 is substantially planar;

wherein the bottom portion 230 is comprised of rigid microwavable material; providing a hand grip mold;

connecting the hand grip base 212 to the hand grip mold;

molding a hand grip around the hand grip base 212;

wherein the molding material is comprised of microwavable material; and disconnecting the hand grip mold from the hand grip.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

II. APPARATUS CONFIGURATION

Embodiments of the present disclosure provide a microwavable material smoothing apparatus 100 comprised of a distributed set of components, including, but not limited to:

A. Base Module 200

A base module 200 consistent with embodiments of the present disclosure may be provided, illustrated at least in FIGS. 1-4 and 12-27. In some embodiments, the base module 200 may comprise a top portion 210, a bottom portion 230, a plurality of apertures, and a divot. In further embodiments, the top portion 210 may connect to the bottom portion 230. In yet further embodiments, the bottom portion 230 may releasably attach to the top portion 210. The bottom portion 230 may be used as a removable and/or replaceable attachment for the apparatus. In other embodiments, the top portion 210 and the bottom portion 230 are the same and/or inseparable. The top portion 210 and/or the bottom portion 230 may be, but not limited to, substantially triangular, circular, elliptical, trapezoidal, rectangular, pentagonal, hexagonal, pyramidal, and/or conical in shape. In some embodiments, at least a portion of the base module 200 may be made from stone such as, but not limited to, granite, any other stone, and/or any stone in which the temperature of the stone rises when microwaves are incident on the stone. In some embodiments, at least a portion of the base module 200 may be formed from any other material which is microwave-safe and which retains heat when exposed to microwave radiation.

a. Top Portion 210

A top portion 210 consistent with embodiments of the present disclosure may be provided, illustrated at least in FIGS. 1-4 and 16-27. In some embodiments, the top portion 210 may comprise a hand grip base 212, illustrated at least in FIG. 17. In some embodiments, the hand grip base 212 may be configured to receive a hand grip module. In some embodiments, the hand grip base 212 may protrude out of the top portion 210. By way of nonlimiting example, the protruding hand grip base 212 may be a "female" pin configured to receive a "male" pin comprised in the hand grip module. In yet further embodiments, the hand grip base 212 may be foldable and/or collapsible. In still further embodiments, the hand grip base 212 may be configured to collapse into the top portion 210. In even further embodiments, the hand grip base 212 may comprise at least one hand grip base protrusion.

Figure 21:
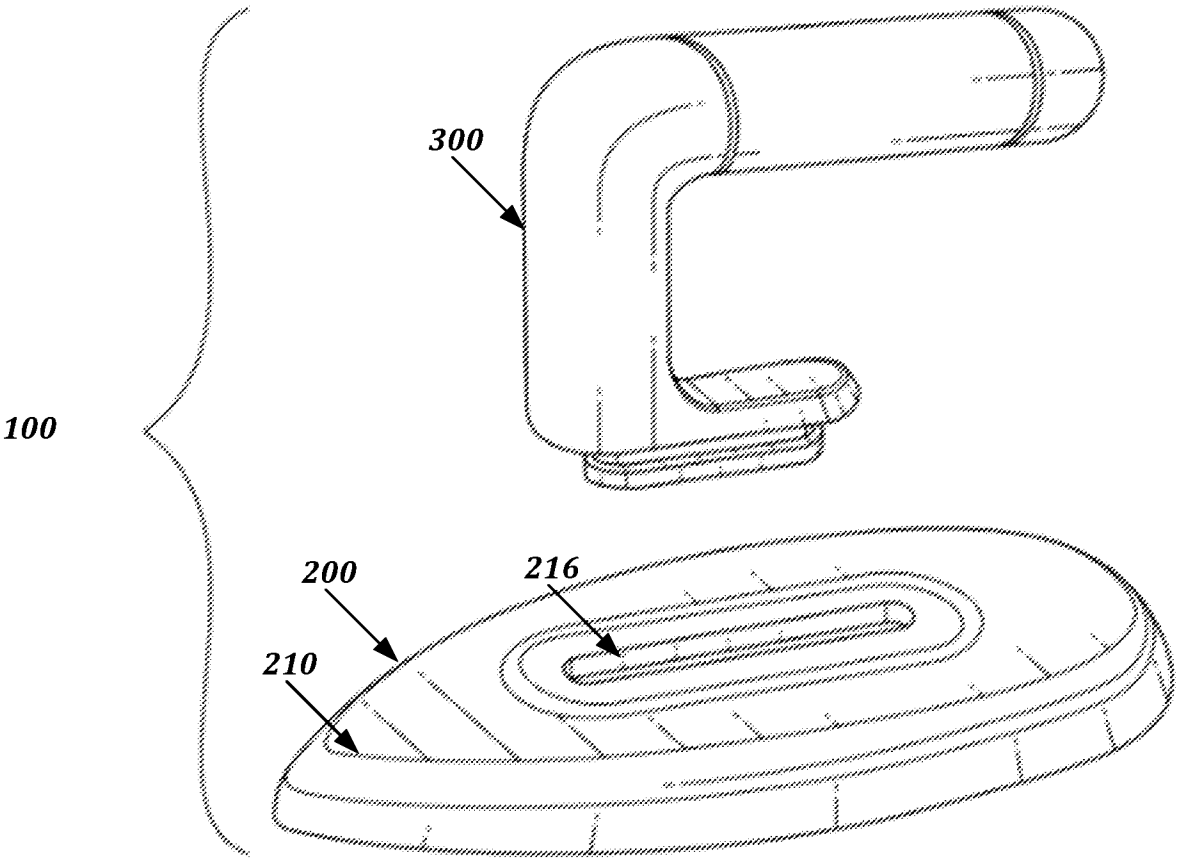
FIG. 21 is another perspective view thereof.
Figure 22:
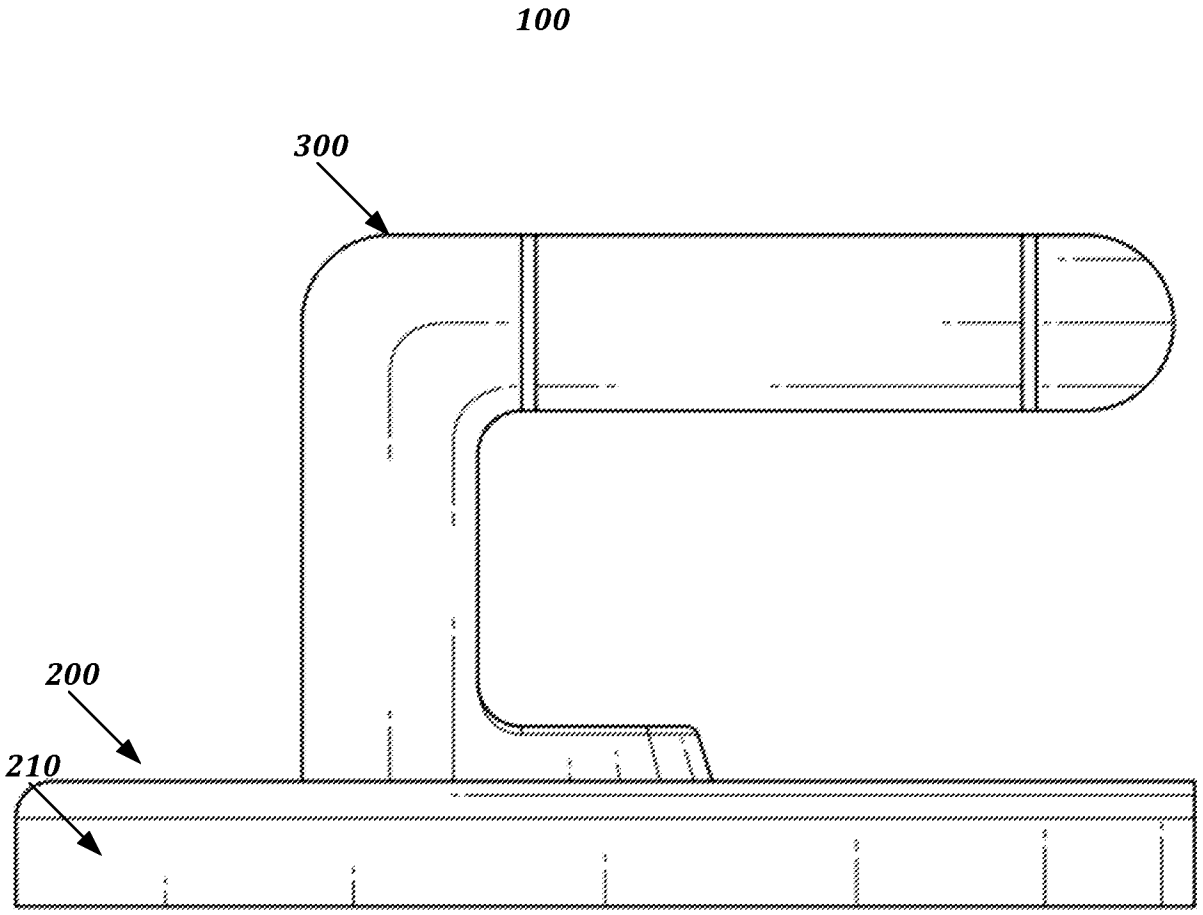
FIG. 22 is a side view thereof.
Figure 23:
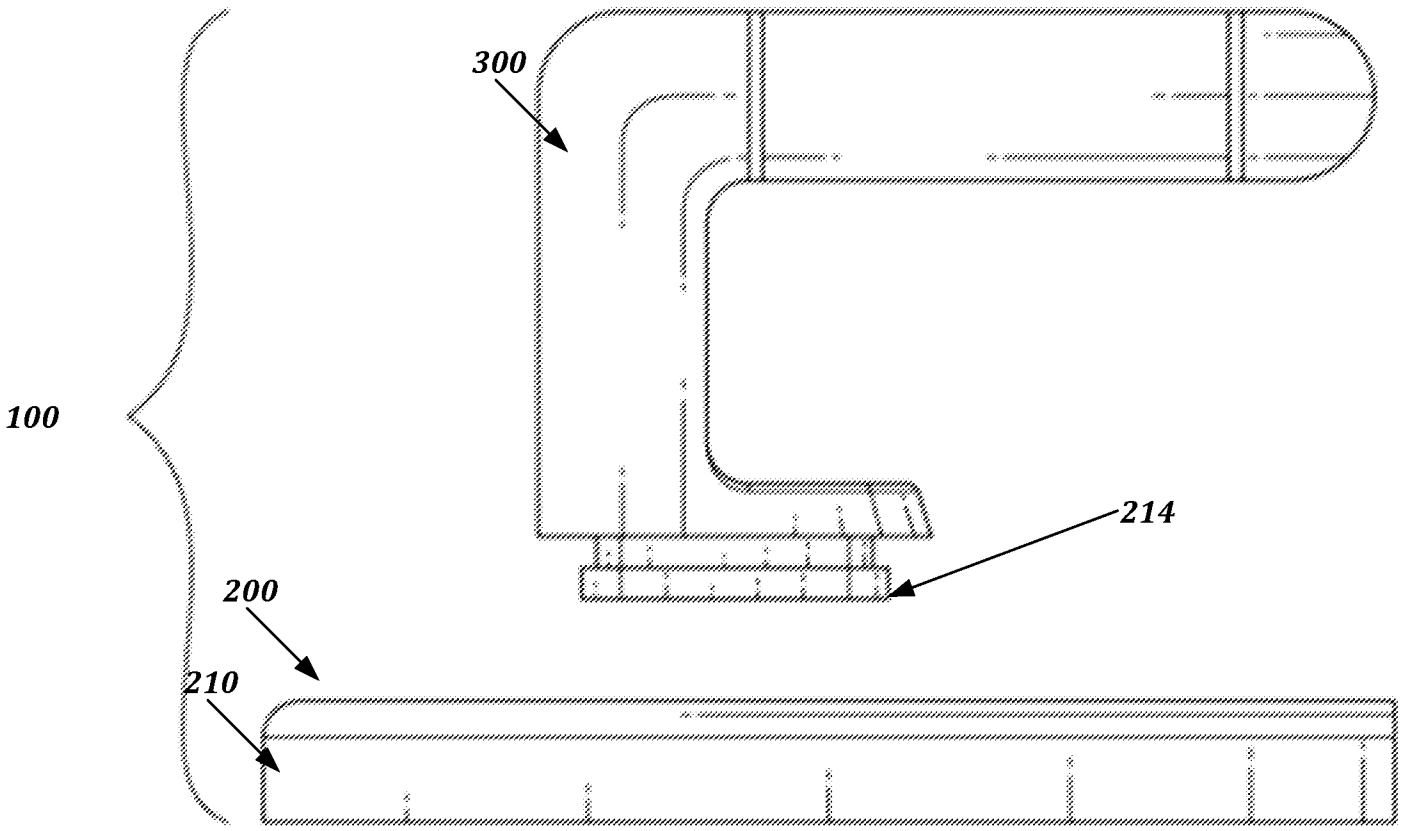
FIG. 23 is another side view thereof.
Figure 24:
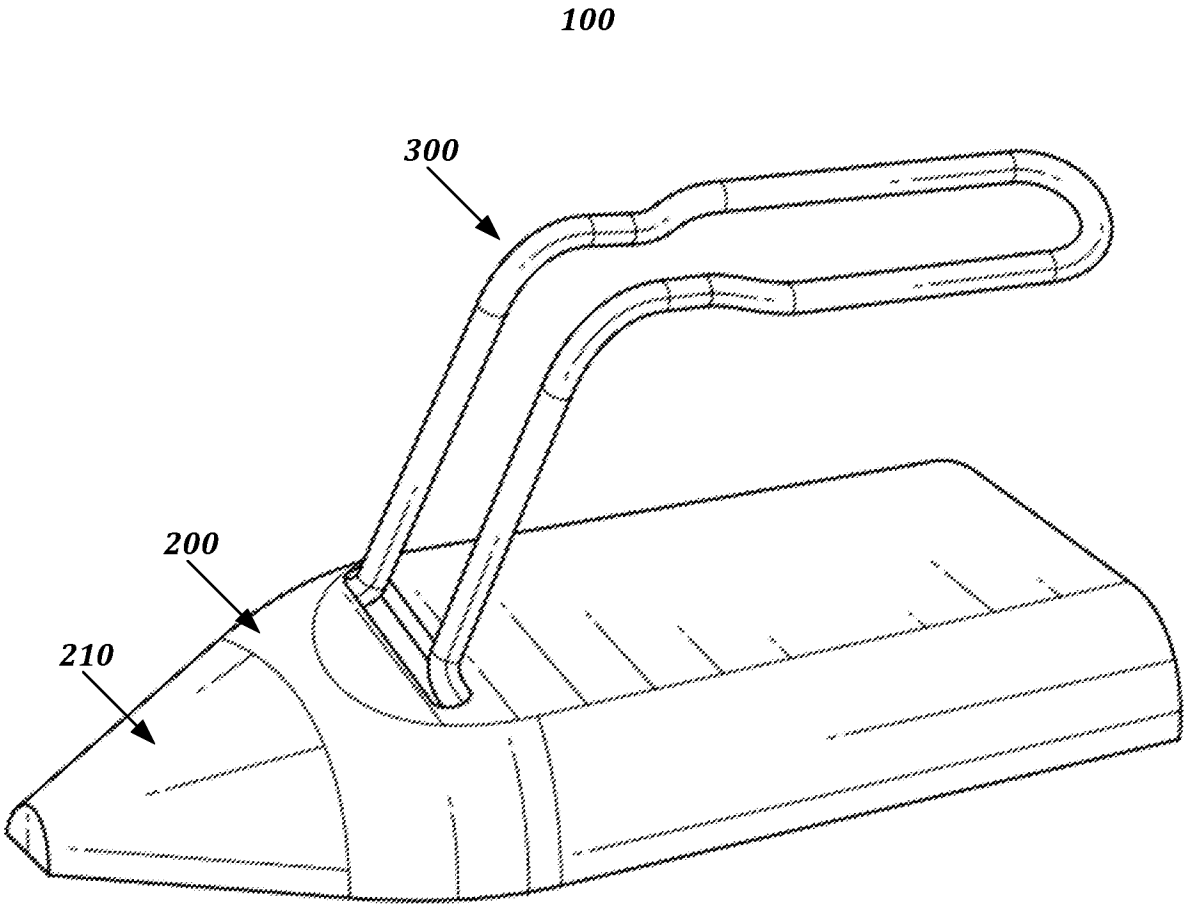
FIG. 24 is a perspective view of an alternate embodiment of the Microwavable Material Smoothing Apparatus 100.
Figure 25:
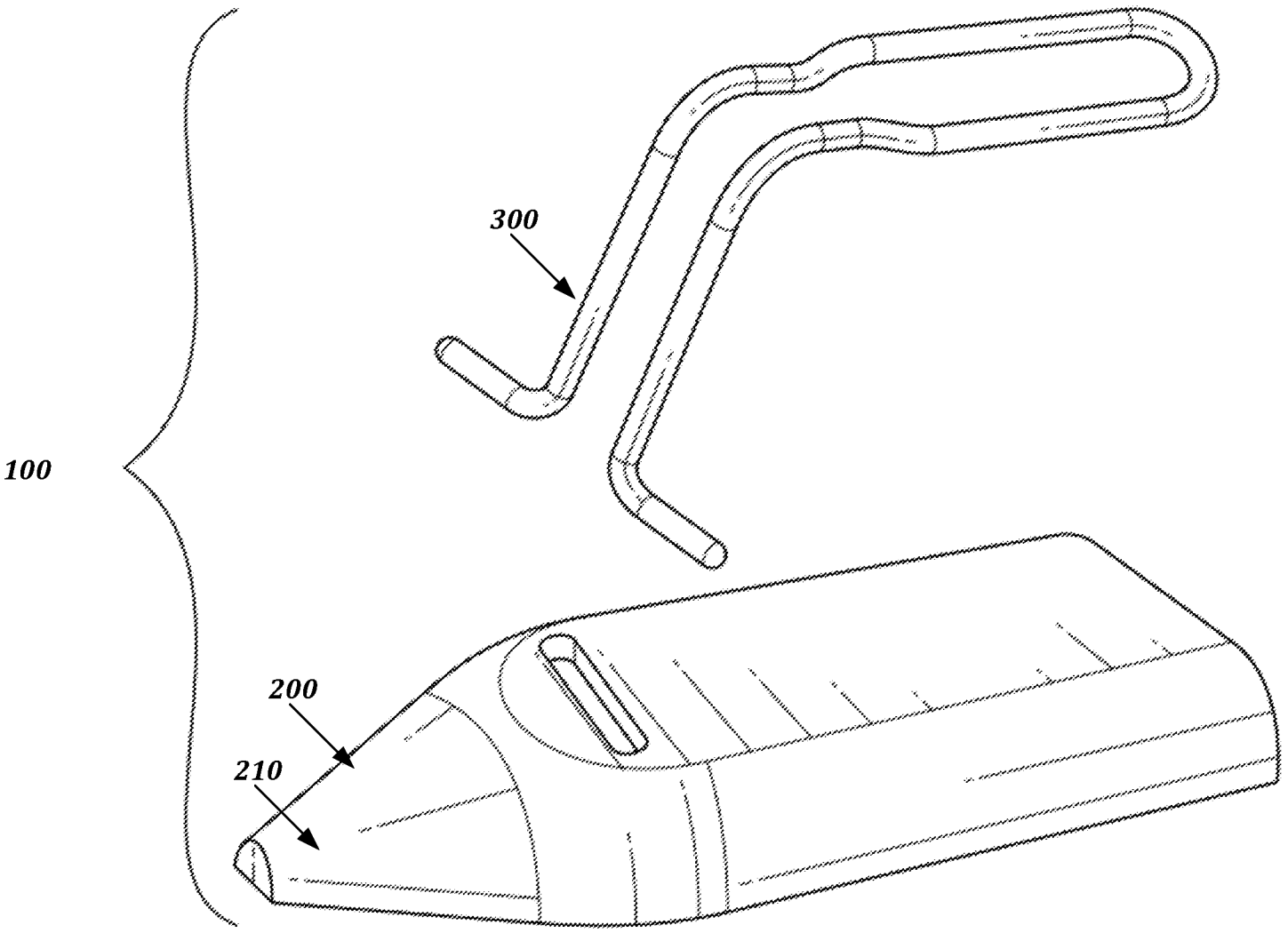
FIG. 25 is another perspective view thereof.
Figure 26:
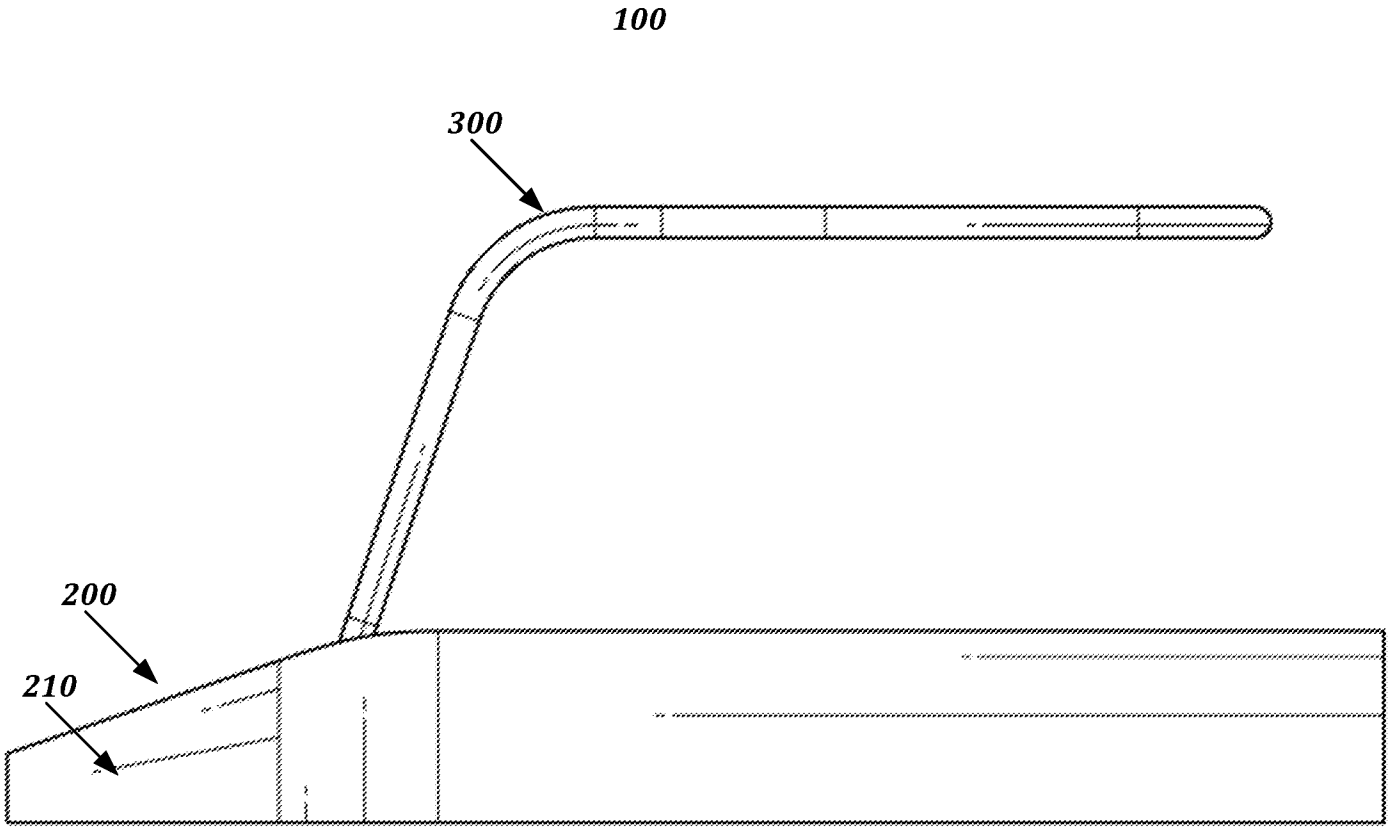
FIG. 26 is a side view thereof.
Figure 27:
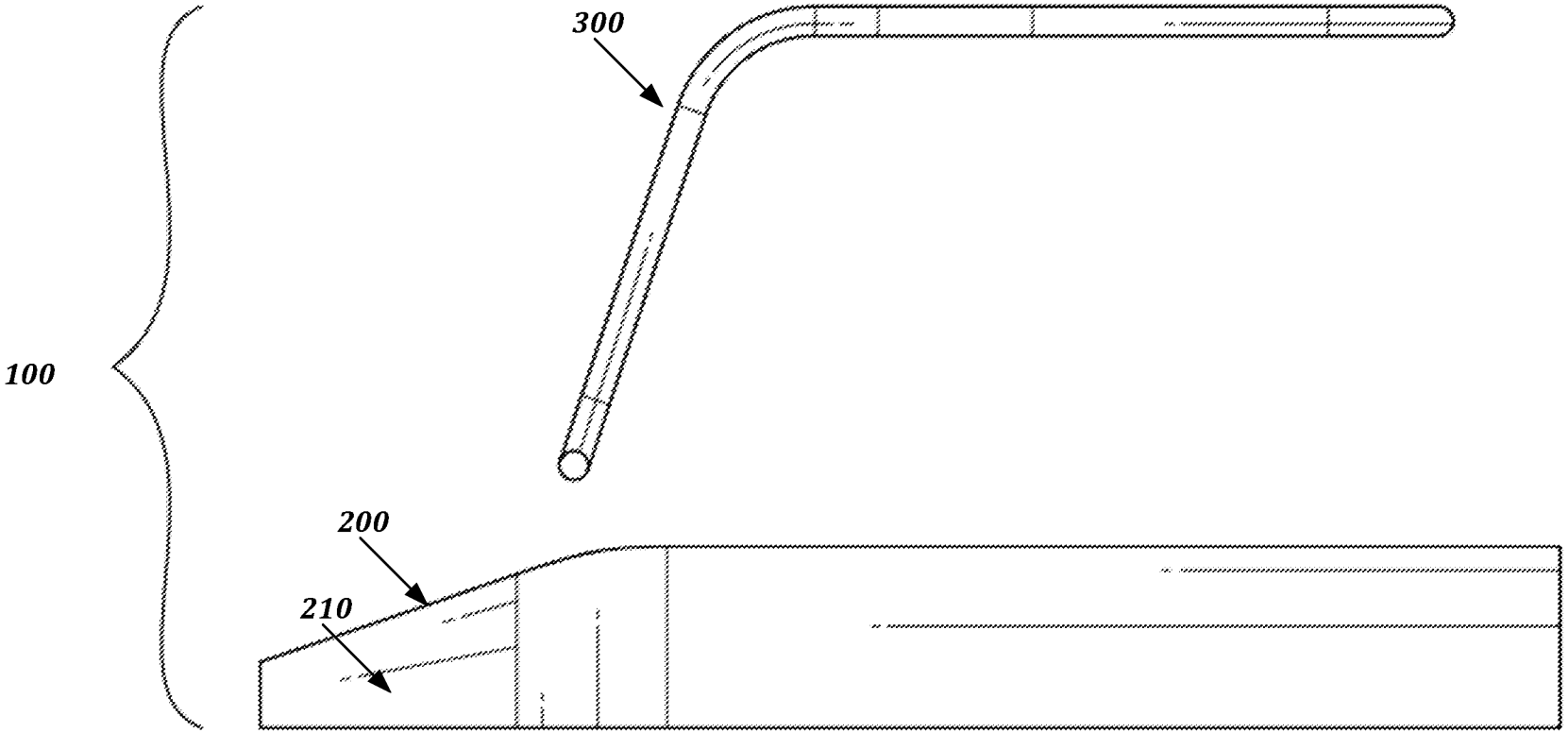
FIG. 27 is another side view thereof.

In some embodiments, the top portion 210 may comprise at least one top portion aperture 216, illustrated at least in FIG. 21. In some embodiments, the at least one top portion aperture 216 may be configured to receive a hand grip module 300. By way of nonlimiting example, the at least one top portion aperture 216 may create a cavity for which a portion of the hand grip module 300 can be placed and/or slide into and releasably attach. In further embodiments, the at least one top portion aperture 216 may comprise a plurality of teeth and/or ledges. The plurality of teeth and/or ledges may be used to receive a plurality of pressure clips and/or other protrusions configured to secure the hand grip module.

In some embodiments, at least one side of the top portion 210 may be planar. In further embodiments, the top portion 210 may comprise a top portion edge.

In other embodiments, the top portion 210 may comprise a top portion divot. In some embodiments, the top portion divot may span proximately above or below the top portion edge. In further embodiments, the top portion divot may span the perimeter of the top portion 210. In yet further embodiments, the top portion divot may span a discrete section of the top portion 210.

b. Bottom Portion 230

A bottom portion 230 consistent with embodiments of the present disclosure may be provided, illustrated at least in FIGS. 12-15. In some embodiments, the bottom portion 230 may be substantially planar. In embodiments, the bottom portion 230 may comprise a variety of shapes when viewed from above such as, for example, being substantially triangular in shape. In embodiments, the bottom portion 230 may comprise a bottom portion edge 232, illustrated at least in FIGS. 12-15. In some embodiments, the bottom portion edge 232 may span the perimeter of the bottom portion 230.

A bottom portion divot 234 consistent with embodiments of the present disclosure may be provided, illustrated at least in FIGS. 12-15. The bottom portion divot 234 may be used assist in ironing around buttons, creases, and other obstructions. In some embodiments, the bottom portion divot 234 may span proximately above the bottom portion edge 232. In some embodiments, the bottom portion divot 234 may span the perimeter of the bottom portion 230. In other embodiments, the bottom portion divot 234 may span a discrete section of the bottom portion 230.

c. Plurality of Apertures

A plurality of apertures consistent with embodiments of the present disclosure may be provided. The plurality of apertures may be embodied as, for example, steam ducts. In some embodiments, the plurality of apertures may span proximate to the bottom portion edge 232. In some embodiments, the plurality of apertures may span the perimeter of the bottom portion 230.

B. Hand Grip Module 300

A hand grip module 300 consistent with embodiments of the present disclosure may be provided, illustrated at least in FIGS. 1-7 and 16-27. The hand grip module 300 may be used to secure and control the base module. In some embodiments, the hand grip module 300 may comprise an internal housing 310 and/or an external housing 320, illustrated at least in FIGS. 1-7. In some embodiments, the hand grip module may be foldable. In some embodiments, the hand grip module 300 may be configured to collapse into the top portion 210. In some embodiments, the hand grip module 300 may connect to the base module 200.

In embodiments, the hand grip module 300 may be made from a flexible metal and/or wire comprising prongs at each end of the flexible wire and/or metal facing opposite of each other, illustrated at least in FIGS. 24-27. The prongs may be configured to be housed in at least one aperture of the base module 200. In this embodiment, a user may engage and/or disengage the hand grip module 300 to and from the base module 200 via pinching (forcibly moving the prongs towards or away from each other) the hand grip module 300.

In still other embodiments, the hand grip module 300 may be made from, for example, from material such as, but not limited to, the following: plastic, thermoplastic, resin, wood, silicon, and/or other insulating microwavable materials.

a. Internal Housing 310

An internal housing (used interchangeably with "lower housing") 310 consistent with embodiments of the present disclosure may be provided. In some embodiments, the internal housing 310 may be molded to secure to the hand grip base 212. The internal housing 310 may be used to connect the hand grip module to the base module. In some embodiments, the internal housing 310 may comprise at least one protrusion, tooth, lip, and/or ledge 312, illustrated at least in FIGS. 5 and 7. The at least one protrusion, tooth, lip, and/or ledge 312 may be disposed around the perimeter and/or edge of the internal housing 310. The at least one protrusion, tooth, lip, and/or ledge 312 may be configured to secure the hand grip module 300 to the base module 200 and/or the top portion 210 and may thereby position the top portion 210 flush with the internal housing 310.

b. External Housing 320

An external housing (used interchangeably with "upper housing") 320 consistent with embodiments of the present disclosure may be provided, illustrated at least in FIGS. 1-7. The external housing 320 may be used to allow a user to secure and/or operate the apparatus. In some embodiments, the external housing 320 may be, for example, a hand grip. In some embodiments, the external housing 320 may comprise a hand grip aperture. The hand grip aperture may be used to connect to a liquid dispensing module to the external housing 320.

In some embodiments, the external housing 320 may comprise a hand grip protrusion. The hand grip protrusion may be used to connect the liquid dispensing module to the external housing 320.

C. Liquid Dispensing Module 400

The liquid dispensing module 400 consistent with embodiments of the present disclosure may be provided (Not shown in FIGS). In some embodiments, the liquid dispensing module 400 may comprise a liquid receptacle 410, a liquid egress module 420, and at least one protrusion. The at least one protrusion may be used to connect the liquid dispensing module 400 to the hand grip module 300. In some embodiments, the liquid dispensing module 400 may be integrated into and/or be housed inside the hand grip module 300.

a. Liquid Receptacle 410

A liquid receptacle 410 consistent with embodiments of the present disclosure may be provided. The liquid receptacle 410 may be used for the storage of liquid to assist in the ironing process.

b. Liquid Egress Module 420

A liquid egress module 420 consistent with embodiments of the present disclosure may be provided. The liquid egress module 420 may be used for at least one channel of fluid flow.

D. Base Module Securing Portion 500

A base module securing portion 500 consistent with embodiments of the present disclosure may be provided as shown in FIGS. 1-4 and 8-11. The base module securing portion 500 may be used to releasably secure and/or retain the base module 200 onto the hand grip module 300.

Figure 9:
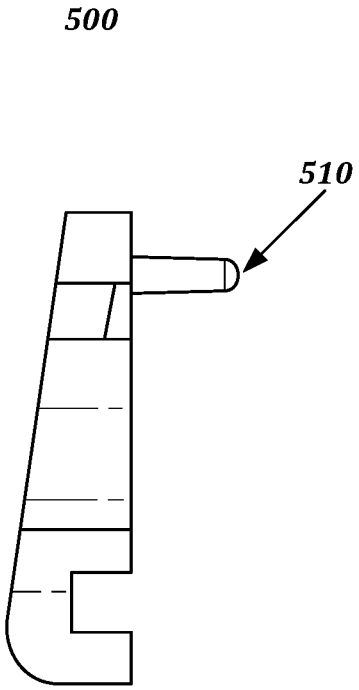
FIG. 9 is a side view thereof.
Figure 10:
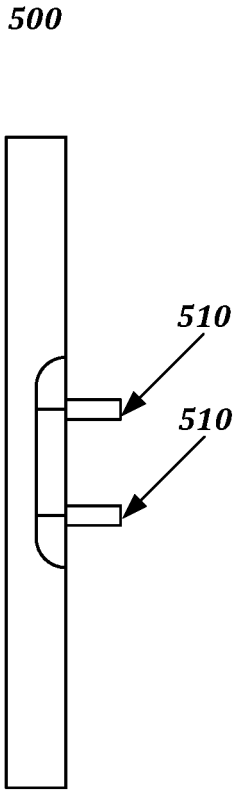
FIG. 10 is a top view thereof.
Figure 11:
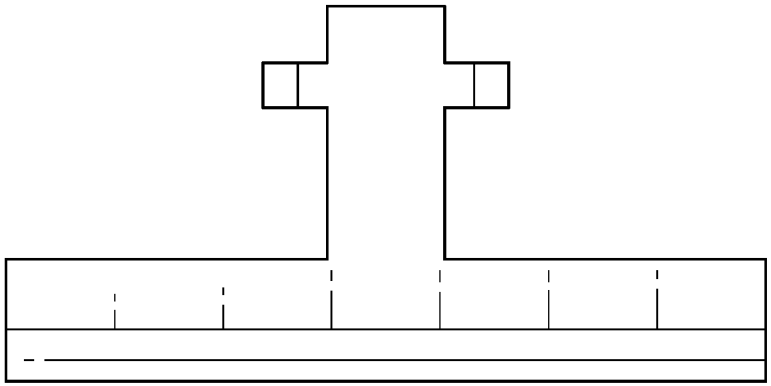
FIG. 11 is a back view thereof.
Figure 12:
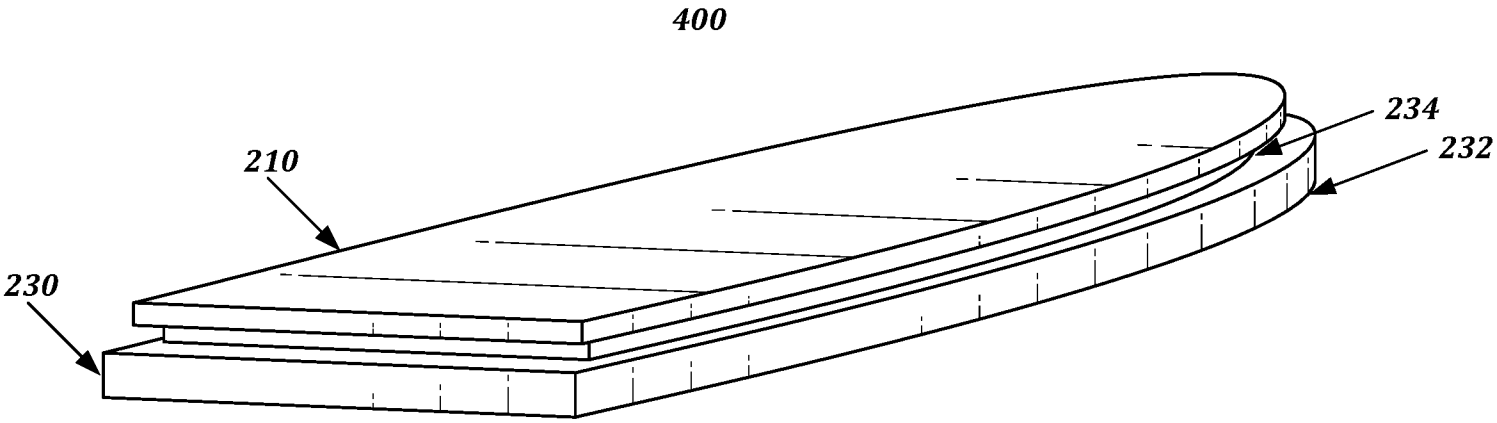
FIG. 12 is a perspective view of a base module 200.
Figure 13:
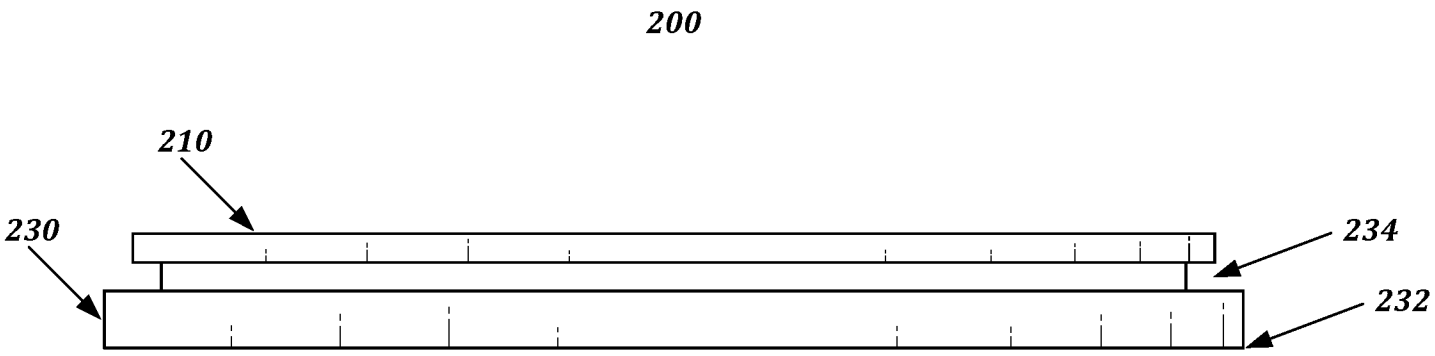
FIG. 13 is a side view thereof.
Figure 14:
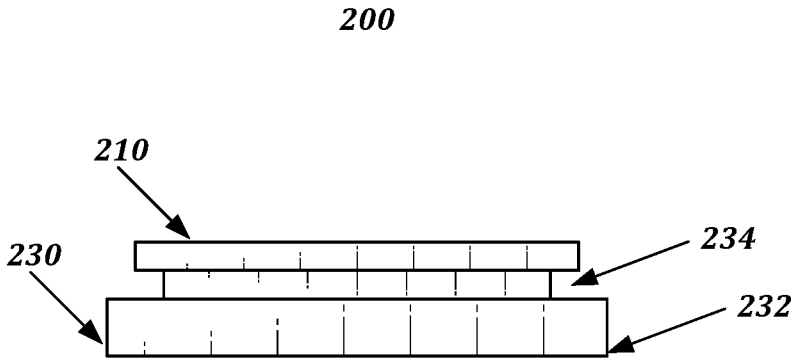
FIG. 14 is a rear view thereof.
Figure 15:
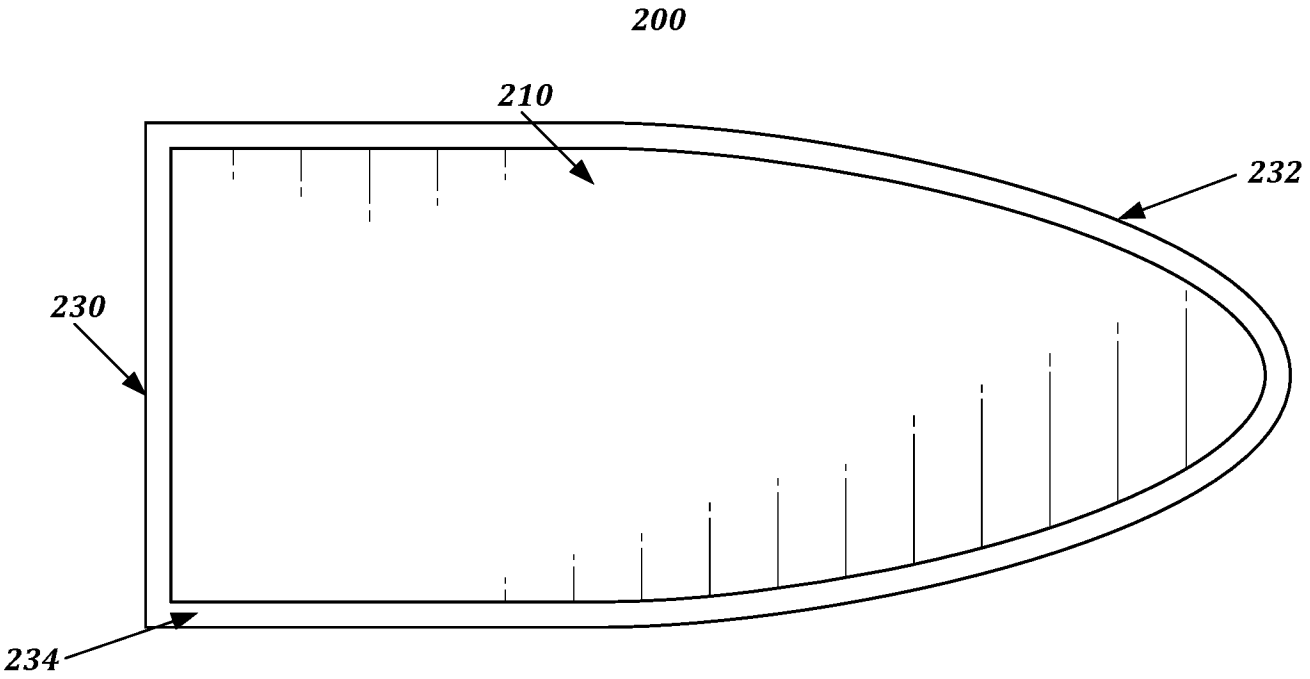
FIG. 15 is a top view thereof.
Figure 16:
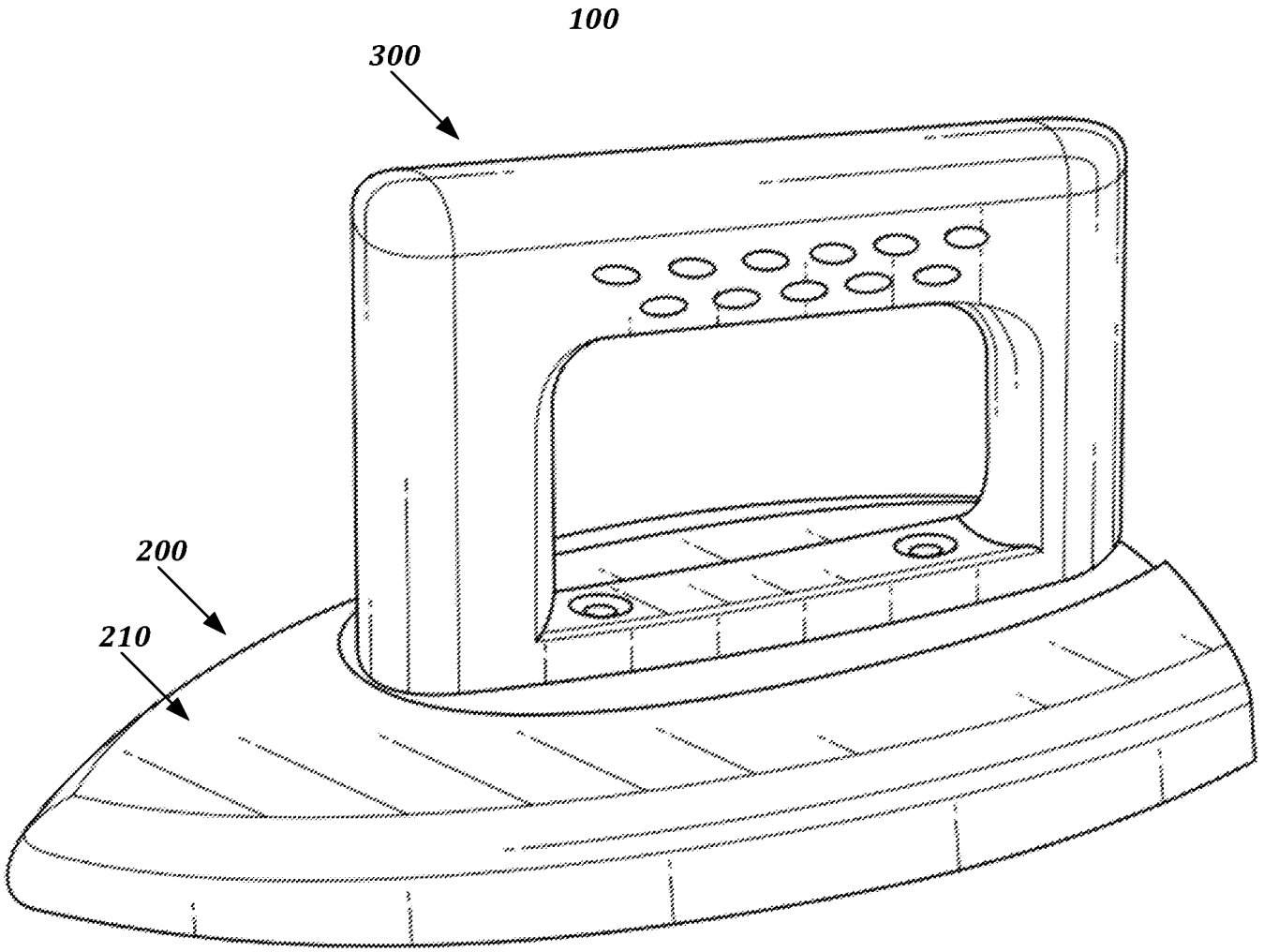
FIG. 16 is a perspective view of an alternate embodiment of the Microwavable Material Smoothing Apparatus 100.
Figure 17:
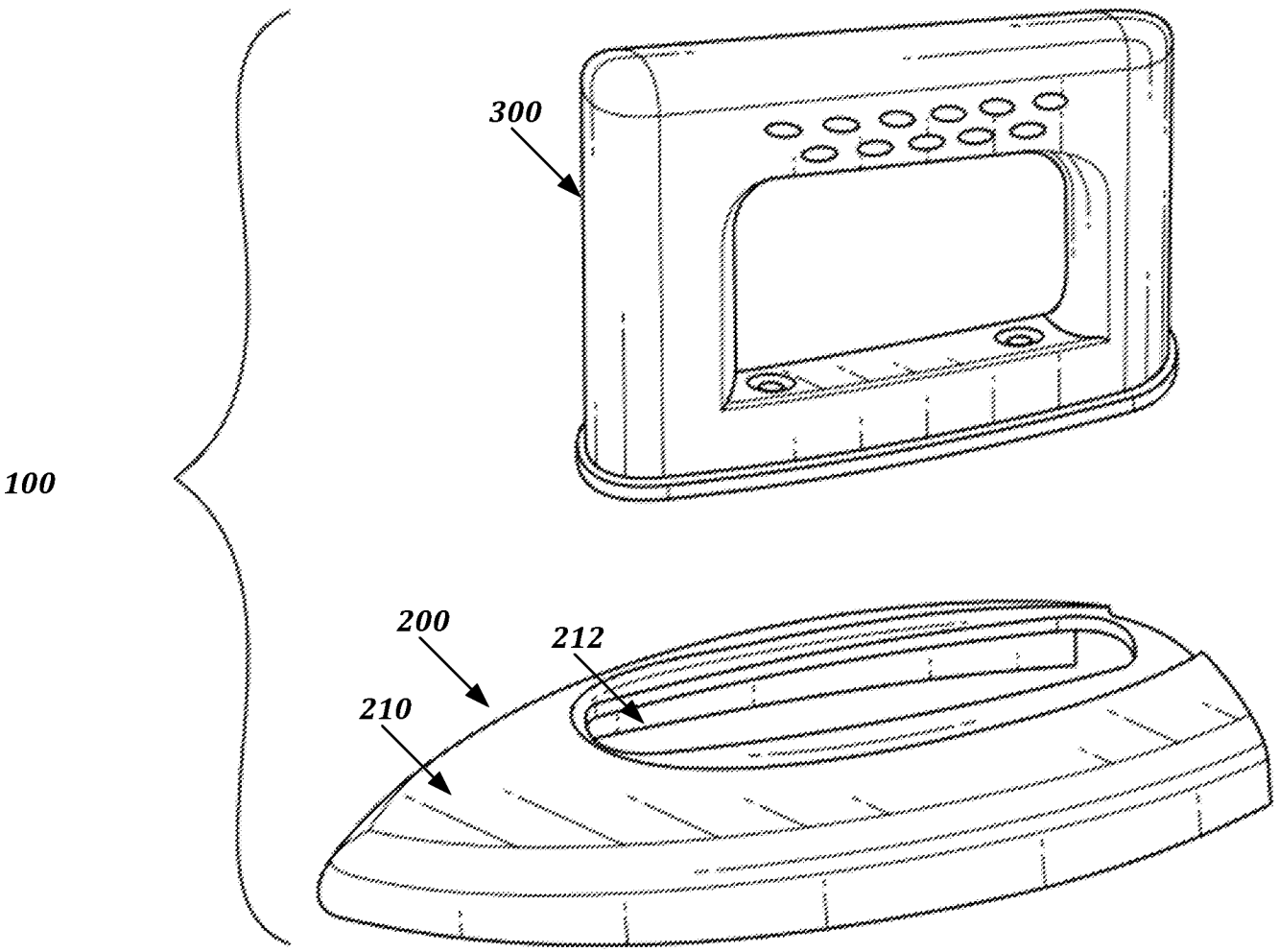
FIG. 17 is another perspective view thereof.
Figure 18:
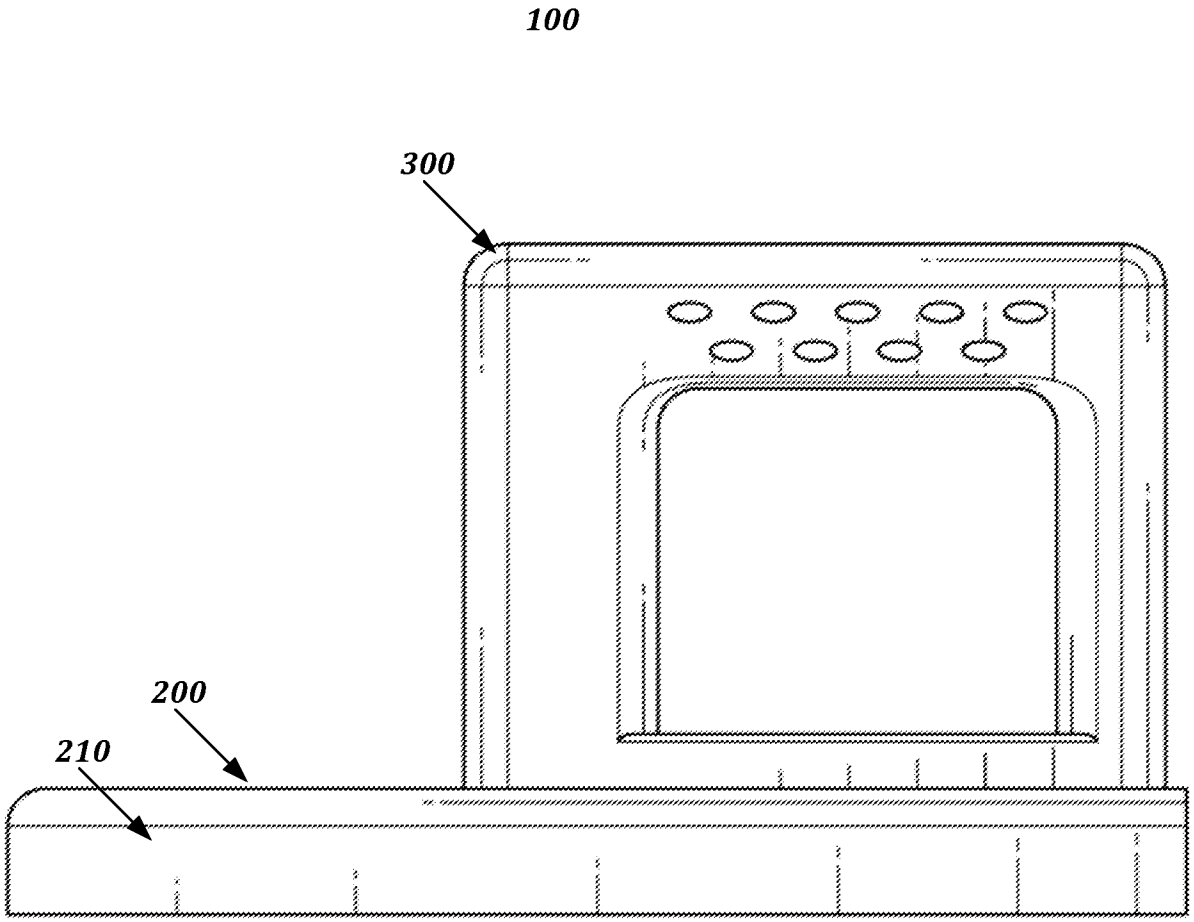
FIG. 18 is a side view thereof.
Figure 19:
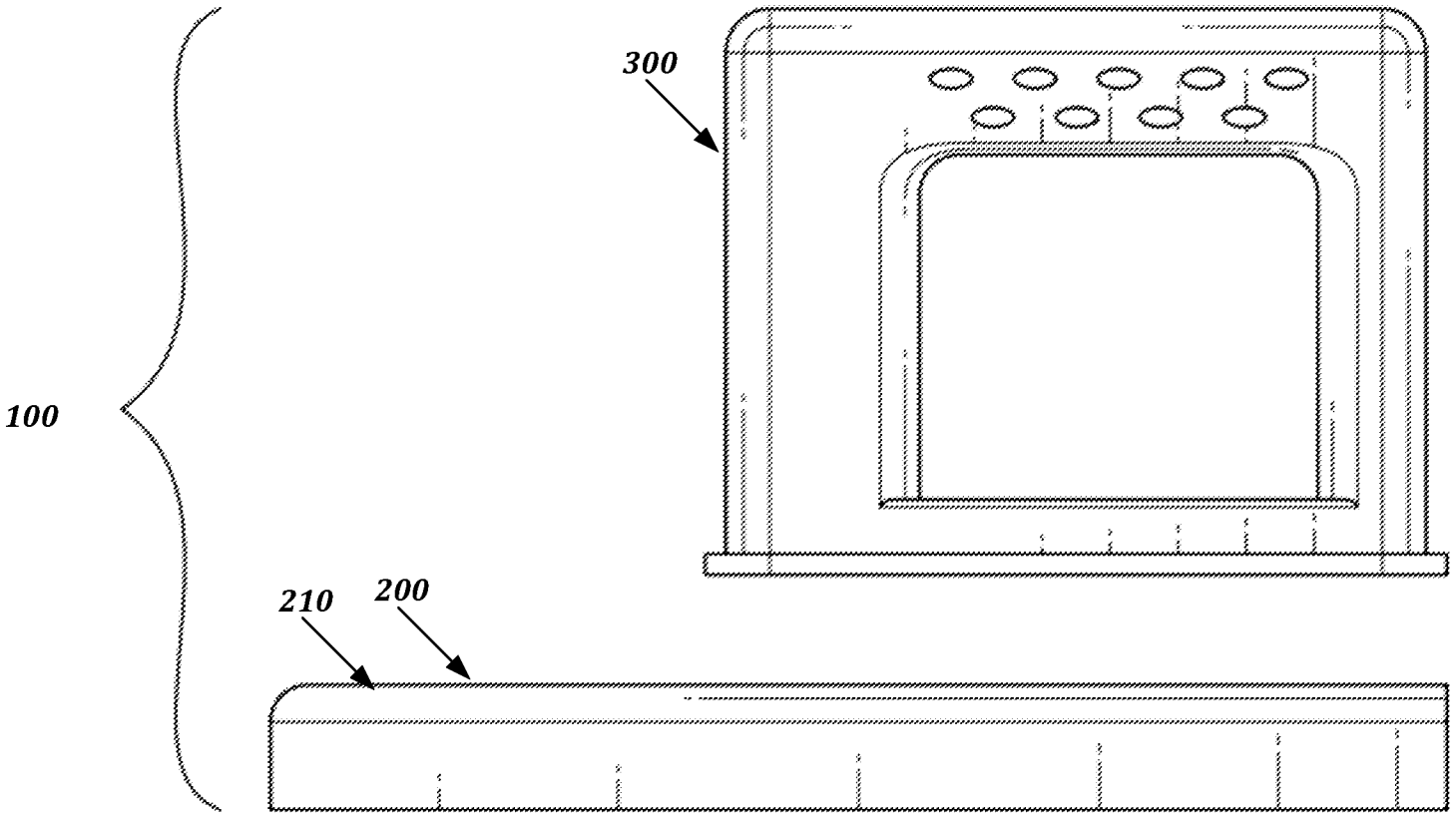
FIG. 19 is another side view thereof.
Figure 20:
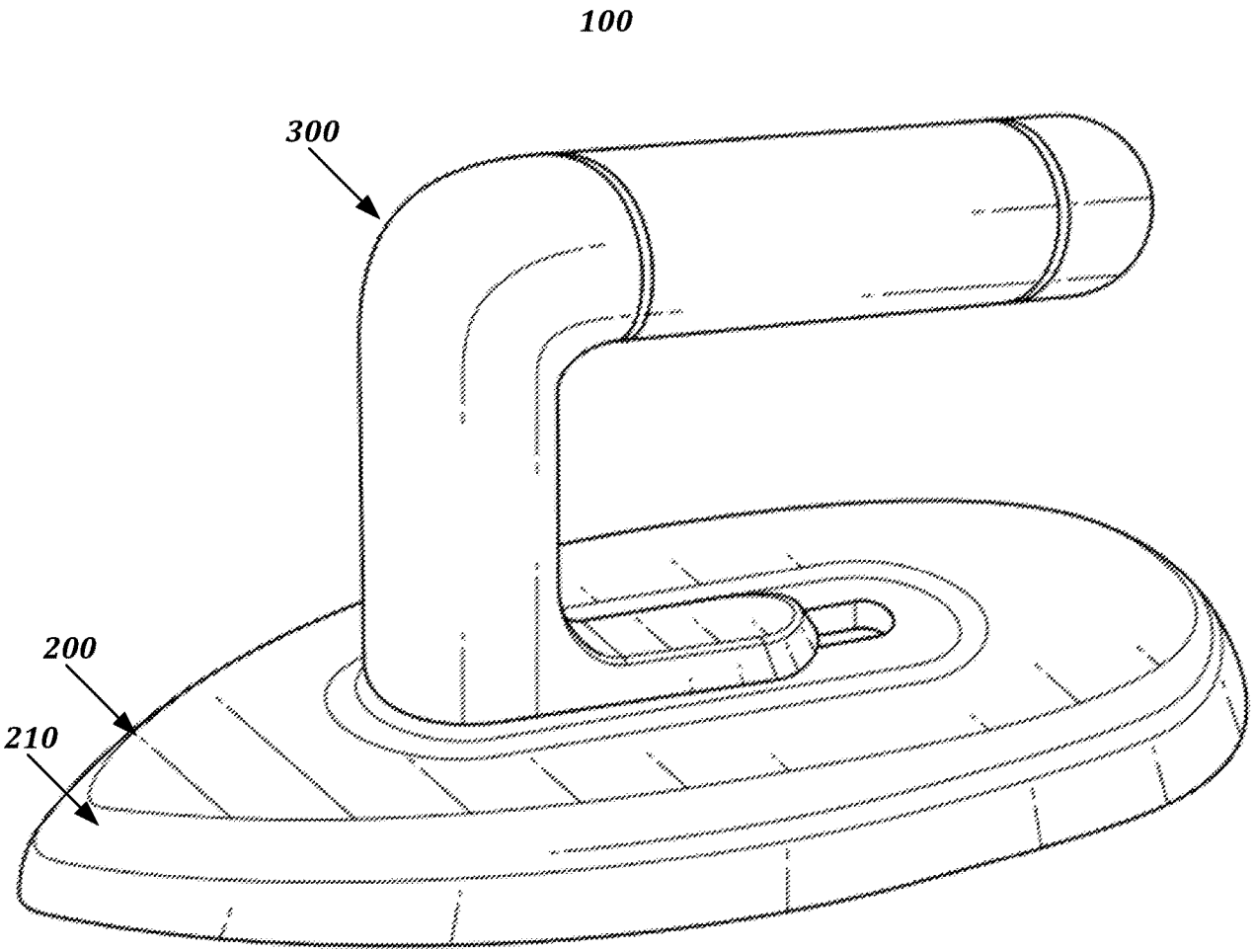
FIG. 20 is a perspective view of an alternate embodiment of the Microwavable Material Smoothing Apparatus 100.

The base module securing portion 500 may comprise at least one protrusion 510, illustrated at least in FIGS. 9 and 10. The at least one protrusion 510 may be configured to be received by at least one aperture of the hand grip module 300.

In some embodiments, base module securing portion 500 may secure to the base module 200. The base module securing portion 500 securing to the base module 200 may be performed via friction, hook and divot, snap fit, confinement, at least one fastener, and/or any other suitable, releasable securing means.

In some embodiments, base module securing portion 500 may secure to the hand grip module 300. The base module securing portion 500 securing to the hand grip module 300 may be performed via friction, hook and divot, snap fit, confinement, at least one fastener, and/or any other suitable securing means.

In some embodiments, the base module 200 and/or hand grip module 300 may comprise divots, grooves, protrusions, and/or indentations dimensioned to receive the base module securing portion 500.

In one embodiment, apparatus 100 may comprise an open position and/or a closed position. The apparatus may transition between the open position and the closed position. For example, a user may cause the apparatus to transition from the open position to the closed position and/or from the closed position to the open position. In the open position, the base module securing portion may be separated from the hand grip module 300 and/or that base module 200. The open position may be used to remove (disengage) the base module 200 from the hand grip module 300. The open position may be further used to connect the base module 200 to the hand grip module 300. The closed position may be used to secure and/or immovably fasten the base module 200 to the hand grip module 300. The closed position may be embodied as, for example:

a. the base module 200 secured to the hand grip module 300, and b. the base module securing portion 500 secured to the base module 200 and the hand grip module 300.

In some embodiments, the base module securing portion 500 may secured to a rear and/or back portion of the base module 200 and to a rear and/or back portion of the hand grip module 300.

III. APPARATUS/SYSTEM USE

Embodiments of the present disclosure provide a system operative by a set of methods comprising instructions configured to operate the aforementioned components in accordance with the methods. The following depicts an example of a method of a plurality of methods that may be performed by at least one of the aforementioned components. Various hardware components may be used at the various stages of operations disclosed with reference to each component.

For example, although methods may be described to be performed by a single component, it should be understood that, in some embodiments, different operations may be performed by different components in operative relation with one another. For example, an apparatus may be employed in the performance of some or all of the stages disclosed with regard to the methods. As such, the apparatus may comprise at least one architectural component disclosed herein.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

Figure 28:
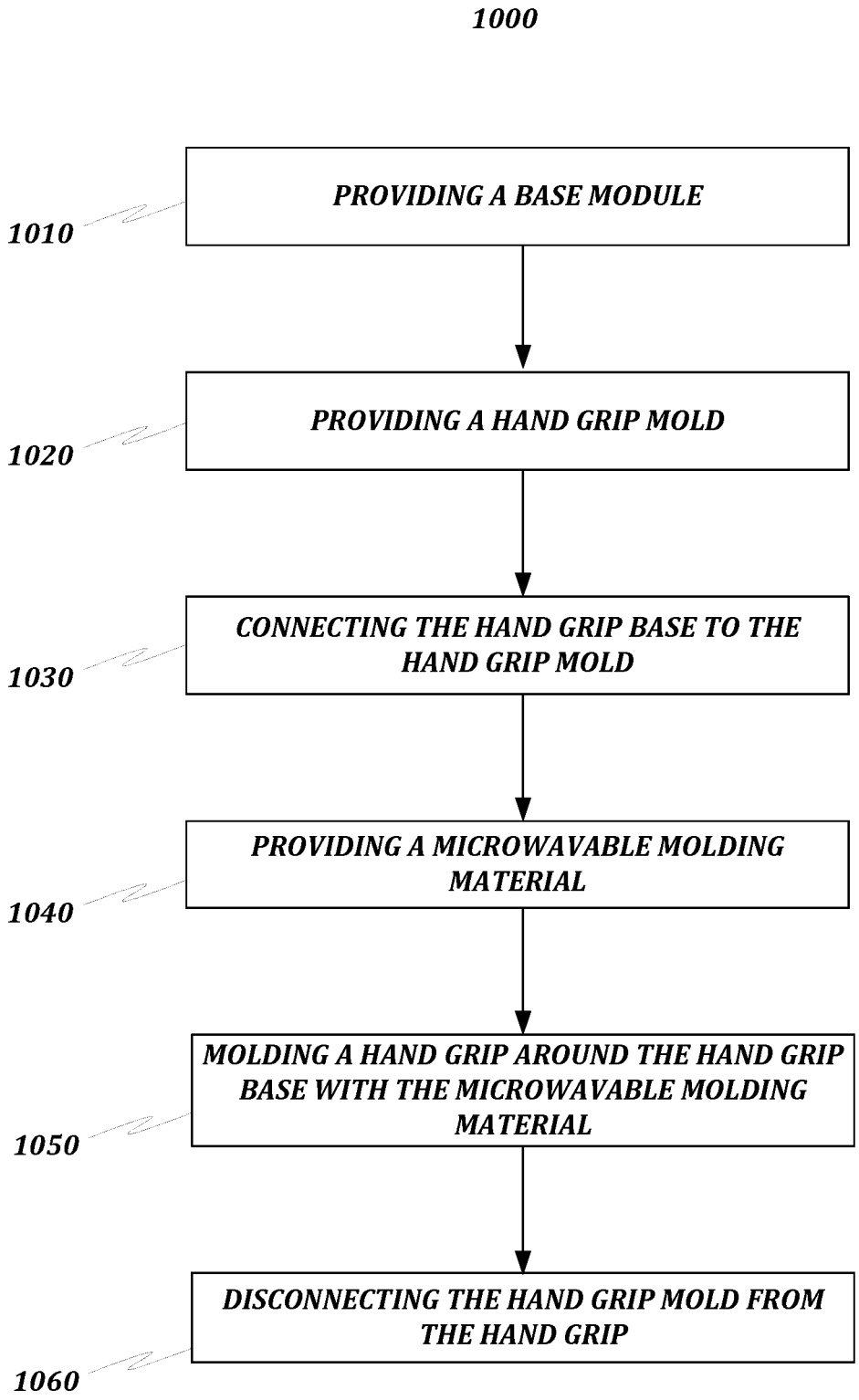
FIG. 28 is a flowchart illustrating a first method 1000.

Consistent with embodiments of the present disclosure, a method 1000 may be performed by at least one of the aforementioned components. The method 1000 may comprise the following stages, illustrated in FIG. 28:

a. 1000—Method for Providing a Microwavable Material Smoothing Apparatus

1010—Providing a base module 200 comprising:

a. Providing a top portion 210 comprised of the following:

i. a hand grip base 212, and ii. a rigid microwavable material, b. connecting the top portion 210 to a substantially planar, and bottom portion 230 made from rigid microwavable material;

c. (Variation) forming a bottom portion edge 232 spanning the perimeter of the bottom portion 230, d. (Variation) forming a plurality of apertures spanning the perimeter of the bottom portion 230;

1020—providing a hand grip mold;

1030—connecting the hand grip base 212 to the hand grip mold;

1040—providing a microwavable molding material;

1050—molding a hand grip around the hand grip base 212 with the microwavable molding material; and

1060—disconnecting the hand grip mold from the hand grip.

(Variation) Providing a base module made from a rigid microwavable material comprising a top portion 210 and a bottom portion 230, providing a hand grip module 300 in a closed position connected to the top portion 210, a. wherein providing the hand grip module 300 in the closed position comprises positioning the hand grip module 300 flush against the top portion 210, b. wherein the bottom portion 230 is substantially planar, moving the hand grip module 300 from a closed position to an open position, a. wherein the open position comprises lifting the hand grip module 300 such that the top portion 210 protrudes from the top portion 210; and b. locking the hand grip module 300 in the open position.

Figure 29:
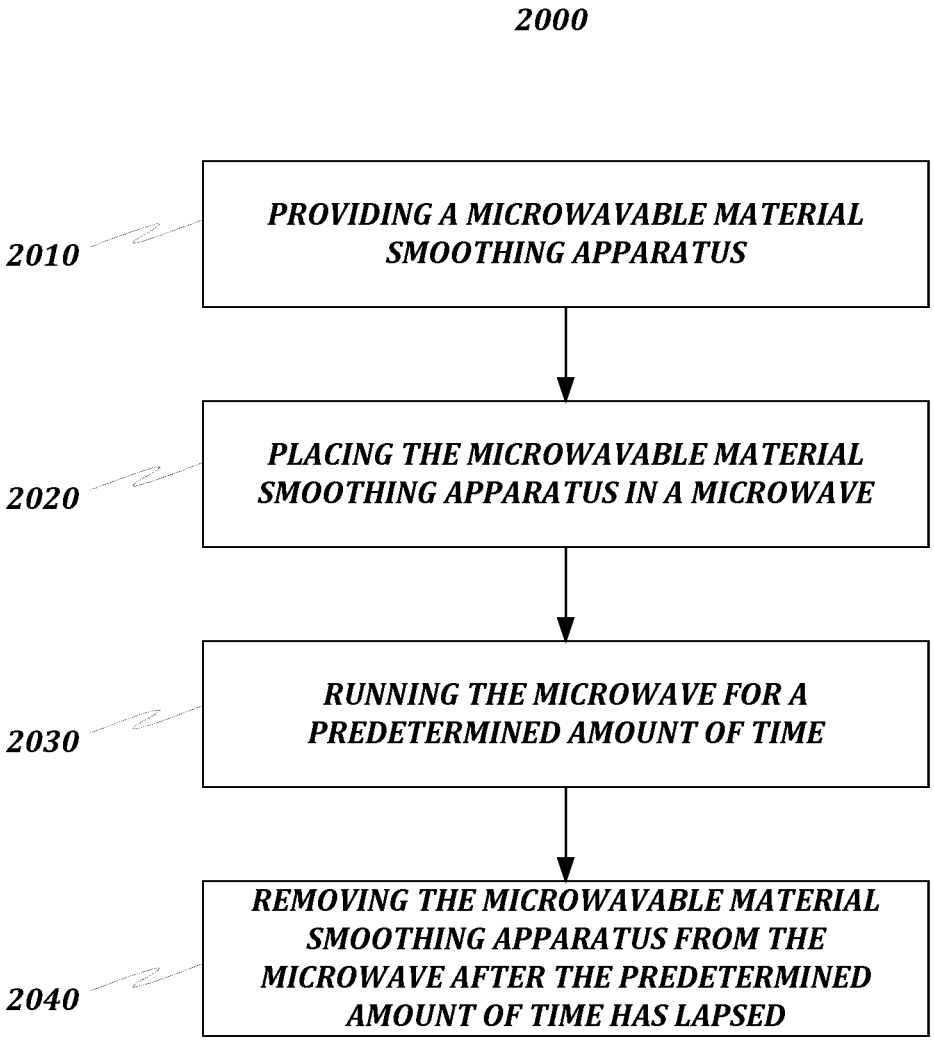
FIG. 29 is a flowchart illustrating a second method 2000.

Consistent with embodiments of the present disclosure, a method 2000 may be performed by at least one of the aforementioned components. The method 2000 may comprise the following stages, illustrated in FIG. 29:

b. 2000—Method for Heating a Microwavable Material Smoothing Apparatus

2010—Providing a microwavable material smoothing apparatus, a. wherein providing the microwavable material smoothing apparatus comprises providing a base module, i. wherein providing the base module comprises a top portion 210, 1. wherein the top portion 210 comprises a hand grip base 212, 2. wherein the top portion 210 is comprised of rigid microwavable material, ii. wherein providing the base module comprises a bottom portion 230, 1. wherein the bottom portion 230 is planar, 2. wherein the bottom portion 230 is comprised of rigid microwavable material, b. wherein providing the microwavable material smoothing apparatus comprises connecting a hand grip module to the hand grip base 212, i. wherein the hand grip module is comprised of insulated microwavable material;

2020—placing the microwavable material smoothing apparatus in a microwave;

2030—running the microwave for a predetermined amount of time, a. wherein the base module increases in temperature the longer the microwave runs; and

2040—removing the microwavable material smoothing apparatus from the microwave after the predetermined amount of time has lapsed.

Although the stages are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

IV. ASPECTS

The following disclose various Aspects of the present disclosure. The various Aspects are not to be construed as patent claims unless the language of the Aspect appears as a patent claim. The Aspects describe various non-limiting embodiments of the present disclosure.

Aspect 1. Among different variants of this product, one might find some that include a material (e.g., a piece of granite or stone), attached to a plastic handle/casing, which warms up quite quickly in the microwave (e.g., 2 minutes) and stays hot for a prolonged period of time.

Aspect 2. The granite/stone, when heated for just a short time (e.g., 1-3 minutes), may improve the ability for ironing out wrinkles in cloth/fabric.

Aspect 3. The Microwavable material smoothing apparatus may be a smaller, portable, on-the-go version of a standard Iron. It may be comprised of a small triangular granite/hot stone base, attached to a plastic handle. After a short time in the microwave, the stone may become hot enough to iron out folds and wrinkles in fabric. This may be considered an easier alternative to bulky steamers, or even to standard irons for smaller ironing jobs. Usage examples range from young to older customer bases, generally for quick and easy touch ups such as:

- For college students in dorms or young adults generally wanting to avoid needing an entire ironing board.
- Quickly fixing wrinkles on clothes, work attire or uniform before leaving for work in the morning.
- Last minute smoothing of a tablecloth or cloth napkins before dinner guests arrive.
- A travel-size product for business and leisure travelers using hotel and motel rooms almost always having microwaves, but may not include an iron.

Aspect 4. A product with the specific purpose of ironing fabric/clothes, fulfilling that purpose only by branching off of, and using an existing household item as it is (microwaves), in a combination of processes (hot stone and microwaving).

Aspect 5. Some variations may include, for example:

Having holes through the bottom of the iron, similar to the holes at the bottom of a normal Iron. This may allow for better airflow for example, or more effective heating up of the moisture and the fabric for more efficient ironing process. That may be an example of using a design specificity on the granite/stone part of the product to better perform the process.

- The particular way in which the granite/stone base is attached to the plastic handle, or to the non-heating part of the product may be varied. The heating element may be releasably connected to the handle part of the product, which may incorporate a specific design/mold/cut for the hot stone. The granite/stone may have a sort of ledge which the plastic would form and solidify into as a way for the plastic handle to hold onto the granite/stone base.
- A slit or divot right above the base of the granite/stone, somewhere of its side (e.g., along at least a portion of the perimeter of the base) may be provided. This may allow for the specific purpose of ironing under and around shirt buttons.
- An attachable, miniature spray-bottle may be attached somewhere to the handle. The spray bottle may be used for spraying a liquid (e.g., water, liquid starch, etc.) on fabric prior to ironing.

V. CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A fabric smoothing apparatus comprising:

a microwavable hand grip module configured to be microwaveable without retaining heat when exposed to microwave radiation, the hand grip module comprising:

a lower housing, and an upper housing connected to the lower housing, the upper housing comprising at least one hand grip; and a microwavable base module configured to retain heat when exposed to microwave radiation, the base module comprising:

a top portion releasably secured to the lower housing, and a bottom portion configured to perform smoothing of a fabric.

2. The fabric smoothing apparatus of claim 1, wherein the microwavable base module is substantially triangular in shape.

3. The fabric smoothing apparatus of claim 1, wherein the bottom portion is substantially planar.

4. The fabric smoothing apparatus of claim 1, wherein the bottom portion further comprises a plurality of apertures.

5. The fabric smoothing apparatus of claim 4, wherein the plurality of apertures spans an edge of the bottom portion.

6. The fabric smoothing apparatus of claim 1, further comprising a bottom portion divot spanning proximately above a bottom portion edge.

7. The fabric smoothing apparatus of claim 1, further comprising a top portion divot spanning proximately below a top portion edge.

8. The fabric smoothing apparatus of claim 7, wherein the lower housing comprises a lower housing protrusion disposed about a perimeter of the lower housing and oriented substantially orthogonal to the lower housing, wherein the lower housing protrusion is configured to be received within the top portion divot, thereby positioning the top portion flush with the lower housing.

9. The fabric smoothing apparatus of claim 1, wherein the hand grip module is foldable.

10. The fabric smoothing apparatus of claim 1, further comprising a microwavable base module securing portion configured to releasably secure the microwavable base module to the hand grip module.

11. The fabric smoothing apparatus of claim 10, wherein the microwavable base module securing portion is secured to the following:

a back portion of the microwavable base module, and a back portion of the hand grip module.

12. The fabric smoothing apparatus of claim 1, further comprising a liquid dispensing module releasably secured to the hand grip module, the liquid dispensing module comprising:

a liquid receptacle, and a liquid egress module.

13. A fabric smoothing apparatus comprising:

a microwaveable hand grip releasably secured to a microwavable base module;

wherein the hand grip is configured to not retain heat when exposed to microwave radiation:

wherein the microwavable base module comprises:

a top portion releasably secured to the hand grip, and a bottom portion configured retain heat when exposed to microwave radiation and to perform dewrinkling of a fabric.

14. The fabric smoothing apparatus of claim 13, wherein the hand grip further comprises at least one protrusion configured to secure into at least one aperture of the top portion of the microwavable base module.

15. The fabric smoothing apparatus of claim 13, wherein the hand grip comprises a generally U-shaped wire such that the hand grip is operable by a hand of a human, the wire comprising opposing prongs disposed at opposite ends of the wire, wherein the prongs are releasably housed in at least one aperture of the microwavable base module.

16. A fabric smoothing apparatus comprising:

a microwavable base module configured to retain heat when exposed to microwave radiation, the microwaveable base module comprising:

a first substantially planar surface, and a divot spanning a perimeter of the first substantially planar surface; and a hand grip module configured to be microwaveable without retaining heat when exposed to microwave radiation, the hand grip module comprising:

a hand grip disposed on a top portion of a second substantially planar surface, and a lip disposed on a bottom portion of the second substantially planar surface, wherein the hand grip module is dimensioned to releasably secure the microwavable base module via the lip securing into the divot.

17. The fabric smoothing apparatus of claim 16, wherein the lip securing into the divot positions the top portion of the first substantially planar surface flush with the bottom of the second substantially planar surface.

18. The fabric smoothing apparatus of claim 16, further comprising a microwavable base module securing portion secured to the following:

a back portion of the microwavable base module, and a back portion of the hand grip module.

19. The fabric smoothing apparatus of claim 16, wherein the microwavable base module is made from a stone material.

20. The fabric smoothing apparatus of claim 19, wherein the stone material is granite.

* * * * *